US006584916B1

(12) United States Patent
Felton et al.

(10) Patent No.: US 6,584,916 B1
(45) Date of Patent: Jul. 1, 2003

(54) SUPPORT AND RELATED SHELF

(75) Inventors: J. Reed Felton, Wauwatosa, WI (US); Douglas G. Lawrence, Rubicon, WI (US)

(73) Assignee: Versatile Products LLC, Menomonee Falls, WI (US)

( * ) Notice: Subject to any disclaimer, the term of this patent is extended or adjusted under 35 U.S.C. 154(b) by 0 days.

(21) Appl. No.: 09/695,953

(22) Filed: Oct. 25, 2000

Related U.S. Application Data

(63) Continuation-in-part of application No. 09/336,899, filed on Jun. 21, 1999, now Pat. No. 6,205,934, which is a continuation-in-part of application No. 09/209,501, filed on Dec. 11, 1998, now Pat. No. 6,053,115.

(51) Int. Cl.[7] ..... A47B 9/00
(52) U.S. Cl. ..... 108/107; 108/110
(58) Field of Search ..... 108/107, 106, 108/110, 144.11, 147.16, 147.17; 211/107, 190, 191, 193, 207, 208

(56) References Cited

U.S. PATENT DOCUMENTS

| | | | | |
|---|---|---|---|---|
| 597,186 | A | * | 1/1898 | Hunter |
| 810,545 | A | * | 1/1906 | Krag |
| 1,742,069 | A | | 12/1929 | Greenwald et al. |
| 1,990,756 | A | * | 2/1935 | Saaf |
| 2,042,517 | A | | 6/1936 | Ellis |
| 2,700,476 | A | * | 1/1955 | Maintain |
| 3,113,818 | A | * | 12/1963 | Armentroudt et al. |
| 3,266,635 | A | * | 8/1966 | McConnell |
| 3,273,720 | A | * | 9/1966 | Seiz |
| 5,127,340 | A | * | 7/1992 | Maro et al. |
| 5,269,599 | A | | 12/1993 | Moring |
| 5,607,070 | A | * | 3/1997 | Hellyer |
| 5,816,419 | A | * | 10/1998 | Lamson |
| 5,921,190 | A | * | 7/1999 | Wood |
| 6,026,752 | A | | 2/2000 | Zachrai |
| 6,053,115 | A | * | 4/2000 | Felton |
| 6,205,934 | B1 | * | 3/2001 | Felton et al. |

FOREIGN PATENT DOCUMENTS

| | | | |
|---|---|---|---|
| DE | 1 290 688 | | 3/1969 |
| FR | 2 763 226 | A1 | 11/1989 |
| GB | 23061 | * | 7/1913 |

* cited by examiner

*Primary Examiner*—Jose V. Chen
(74) *Attorney, Agent, or Firm*—Quarles & Brady, LLP

(57) ABSTRACT

An adjustable shelving apparatus including at least one shelving member and at least one upright frame member wherein the shelving member can be mounted to the frame member in each of a horizontal and a vertical position, the frame member forming a coupler assembly and the shelving member also forming a coupler assembly wherein the shelving member has a rear surface and at least one end surface, an end extending member extending laterally from the end surface and a rear portion of the shelf adjacent the rear surface forming another portion of the shelving member coupler assembly. The disclosure also includes a supportable member for use with the vertically mounted shelving member, the shelving member having a thickness between top and bottom oppositely facing surfaces and the supportable member having a bracket that receives the shelving member edge there by supporting a portion of the supportable member adjacent the shelving member edge.

14 Claims, 24 Drawing Sheets

FIG. 1
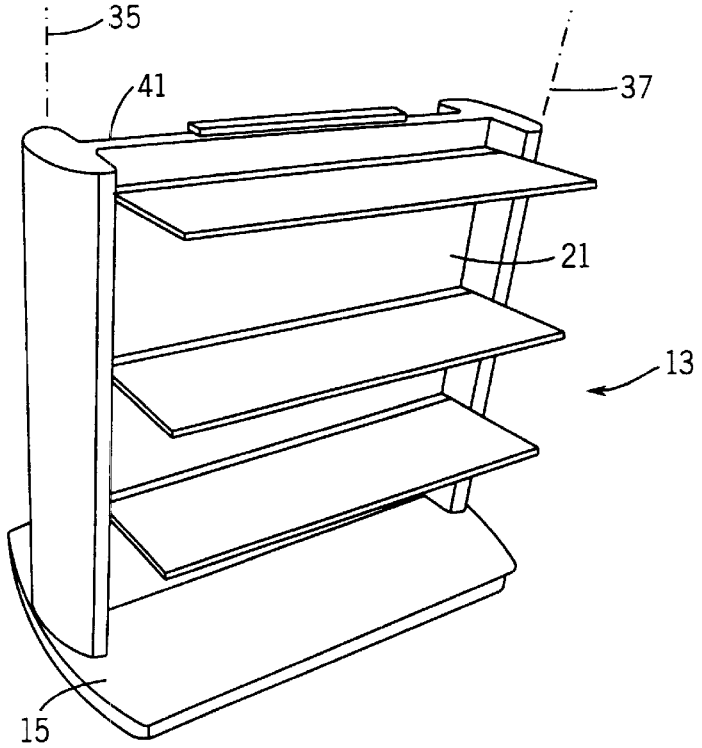
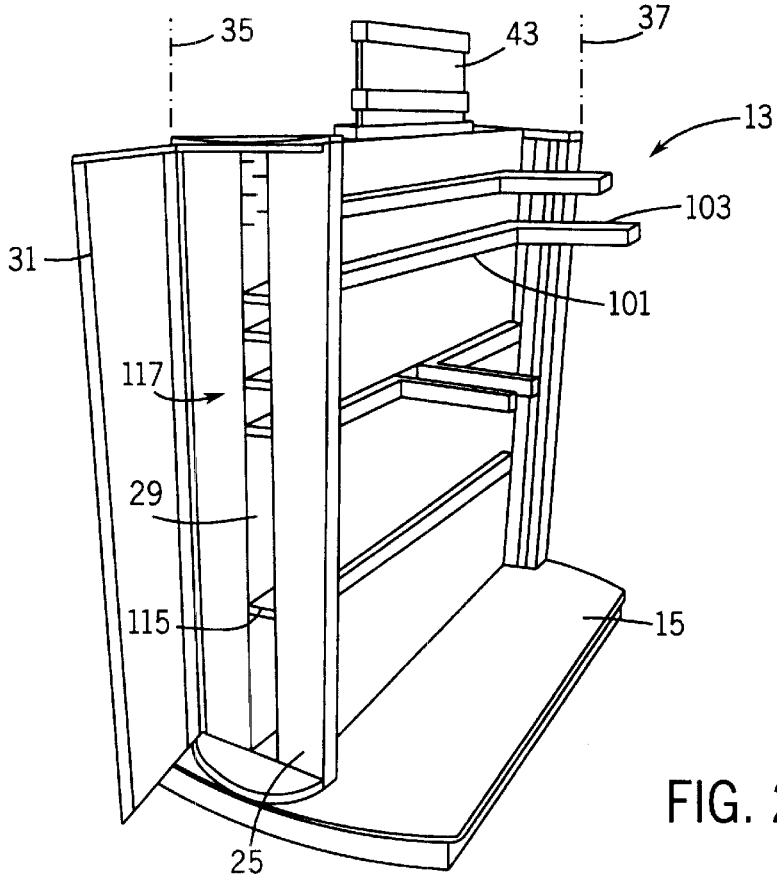
FIG. 2

FIG. 11
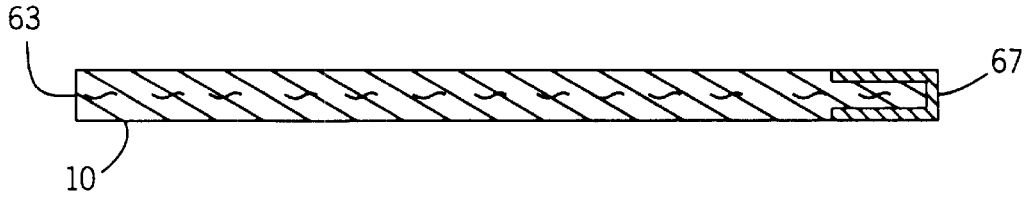
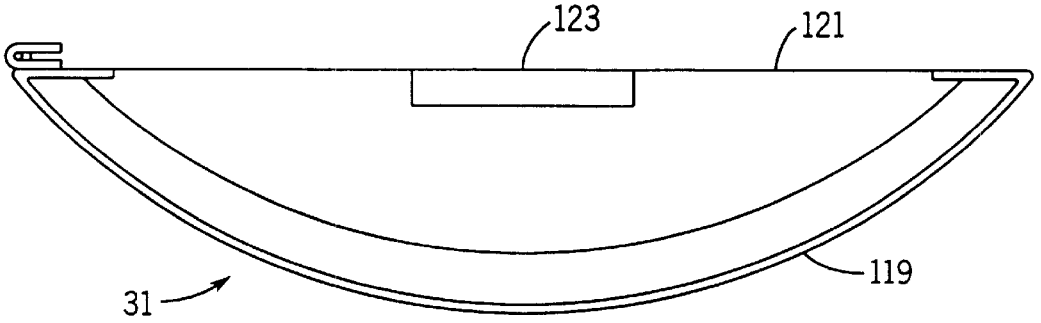
FIG. 17
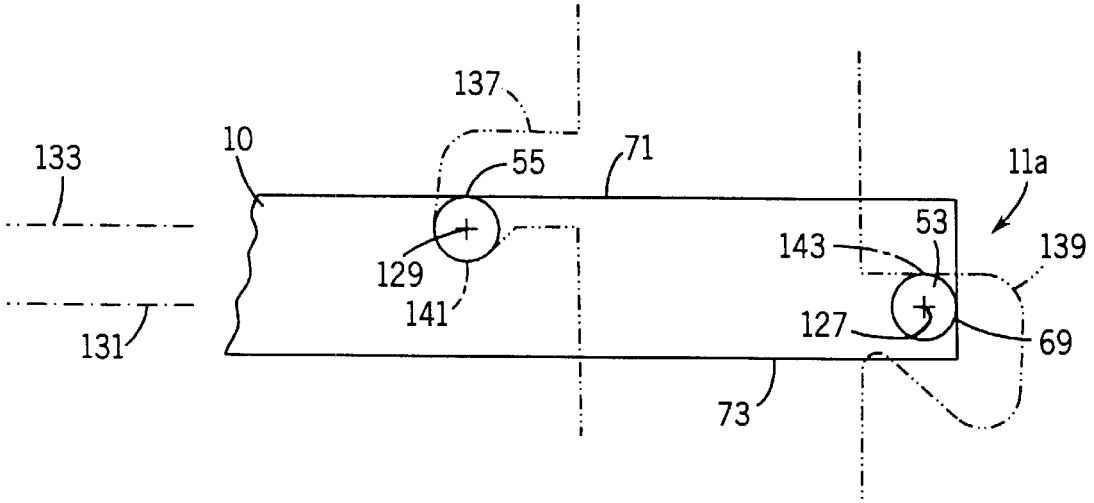
FIG. 18

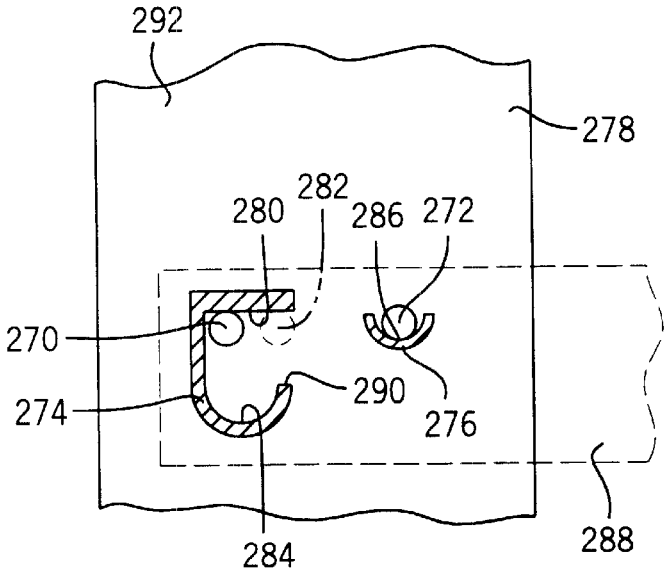
FIG. 24
FIG. 25
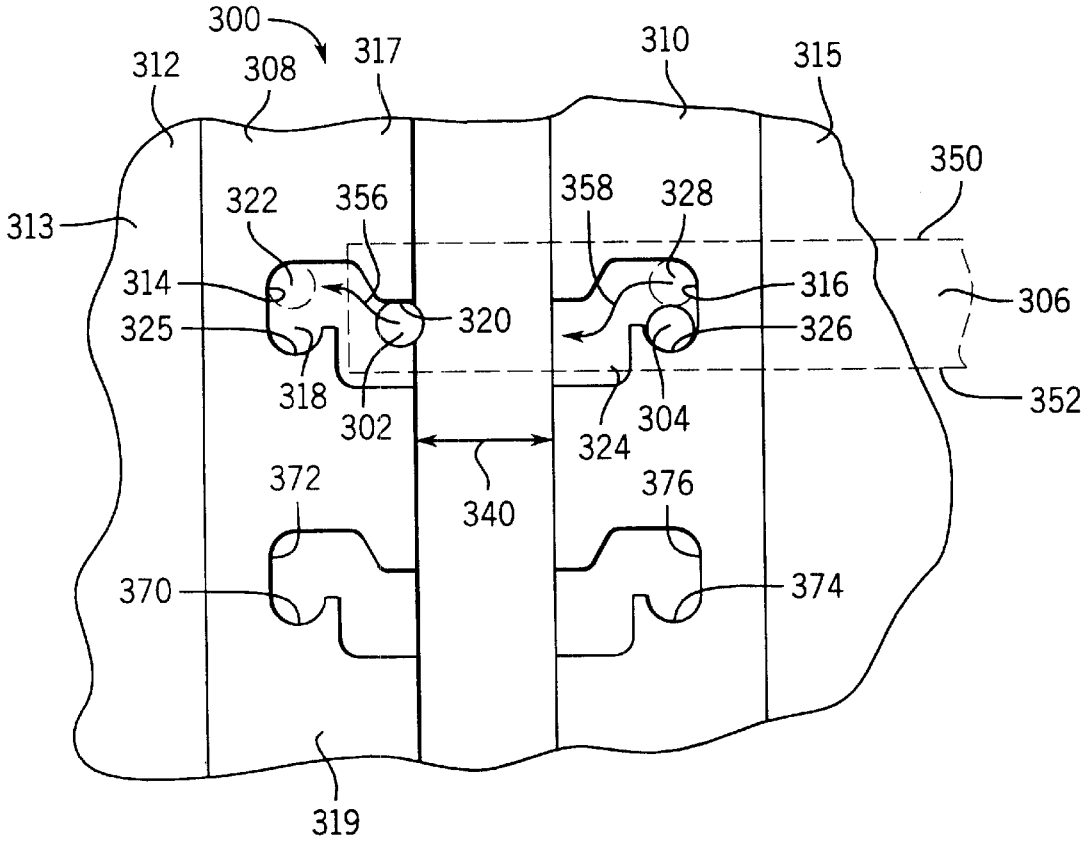

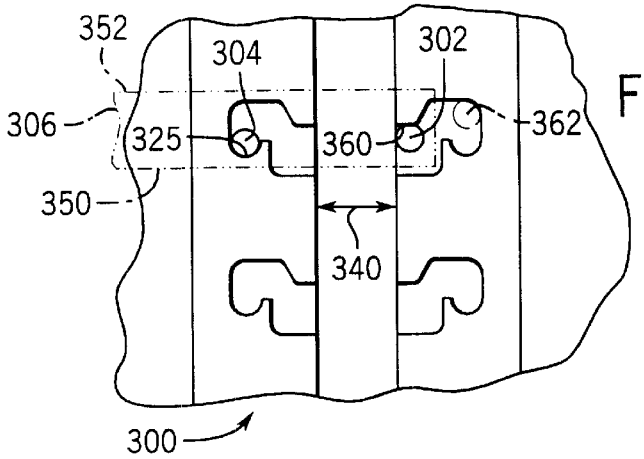
FIG. 26
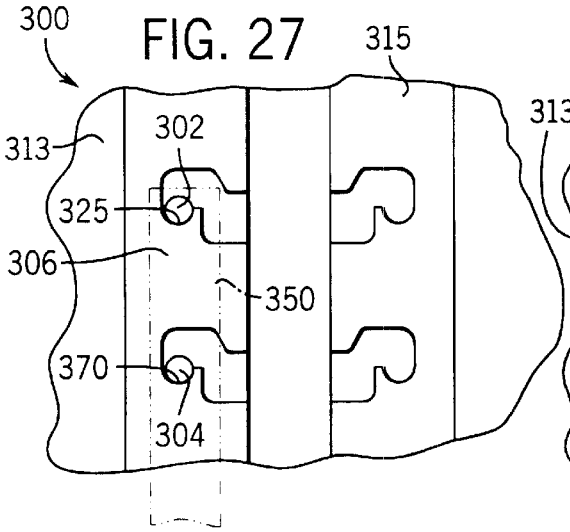
FIG. 27
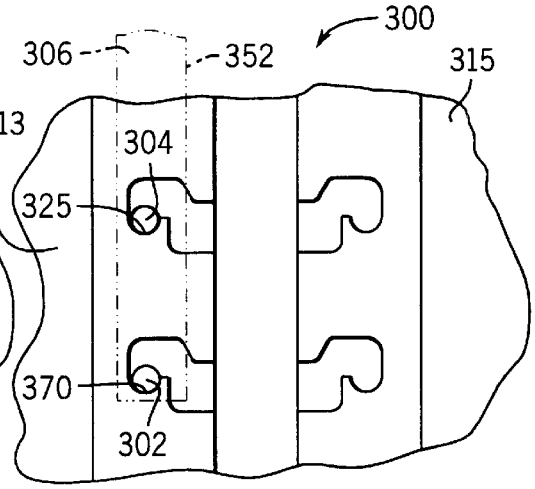
FIG. 29
FIG. 28
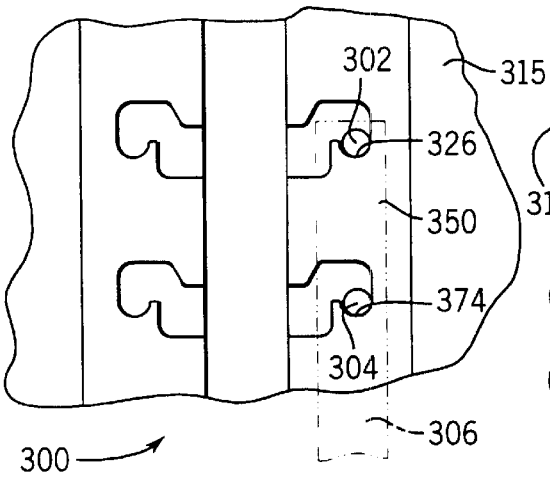
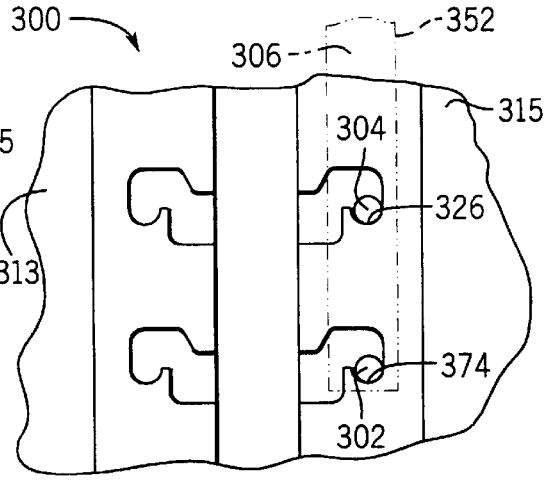
FIG. 30

FIG. 32
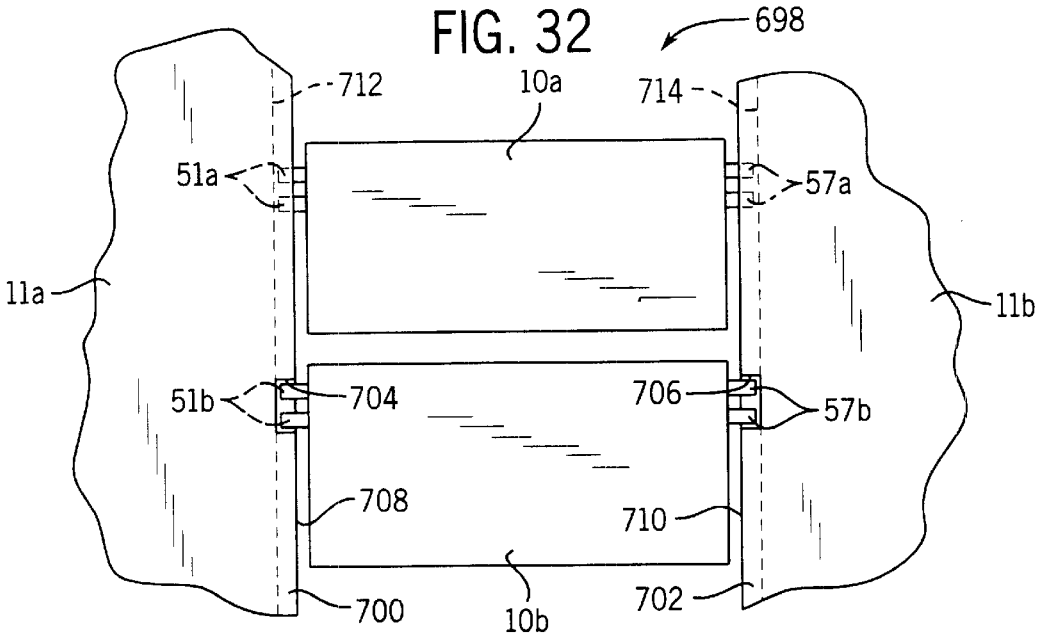
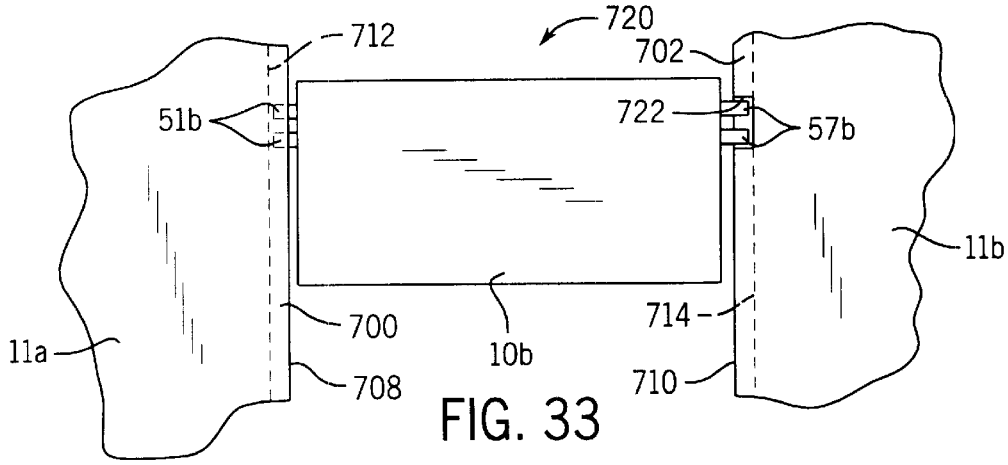
FIG. 33
FIG. 34
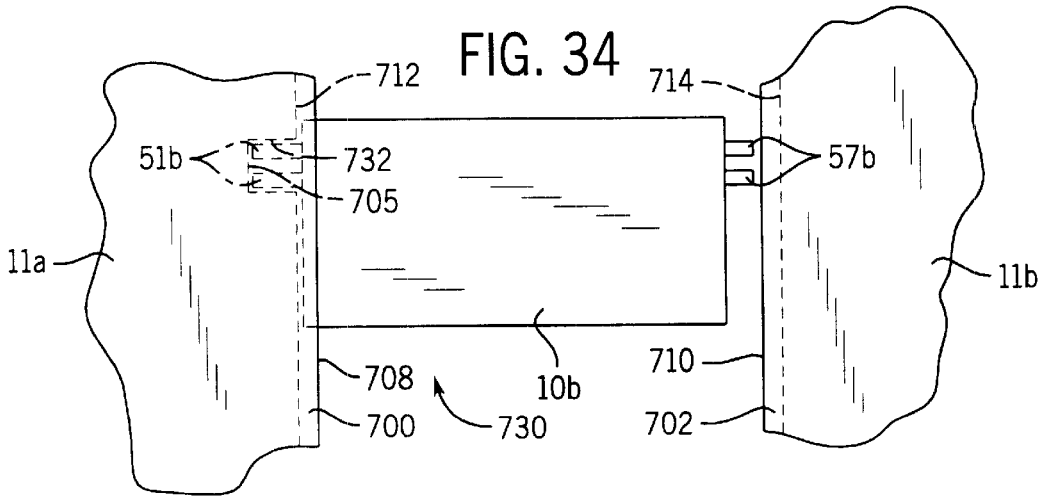

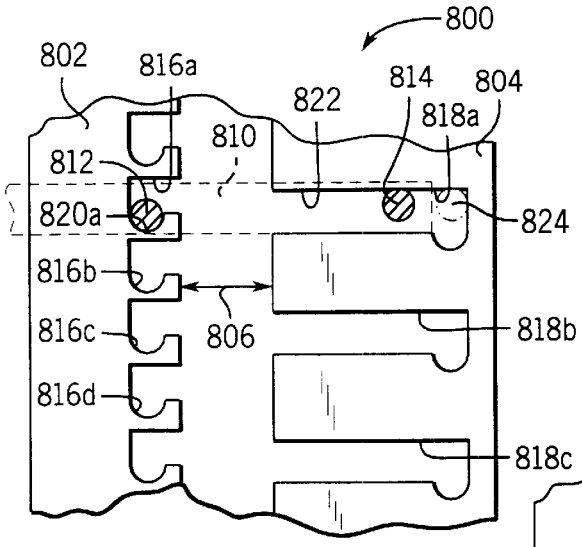
FIG. 37
FIG. 38
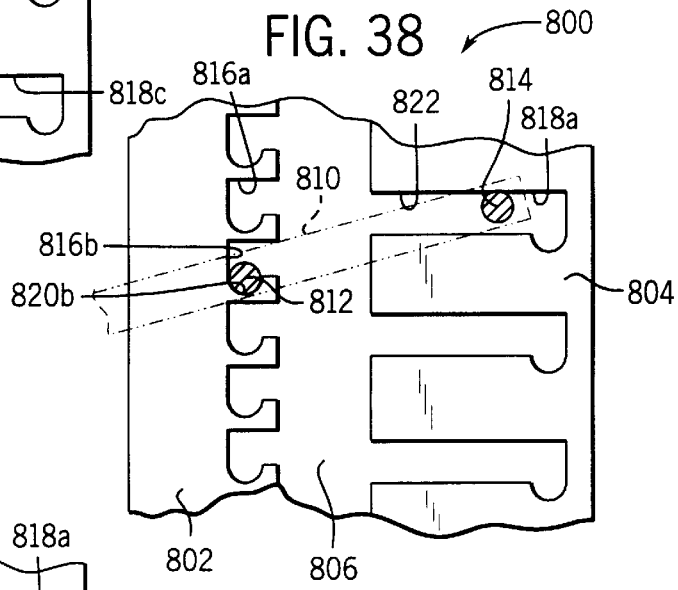
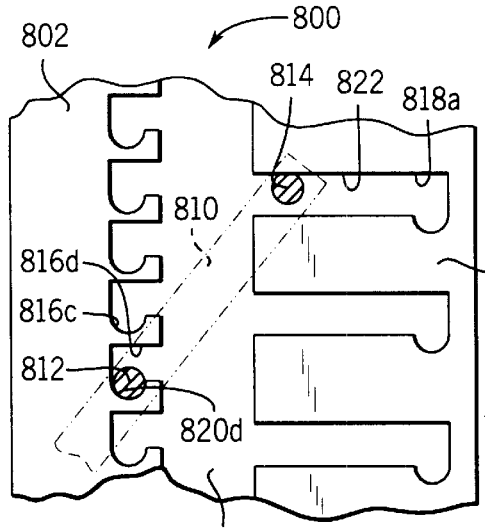
FIG. 39
FIG. 40
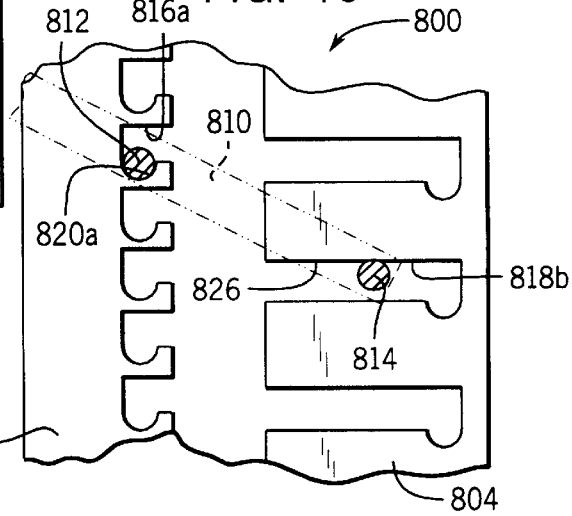

FIG. 50
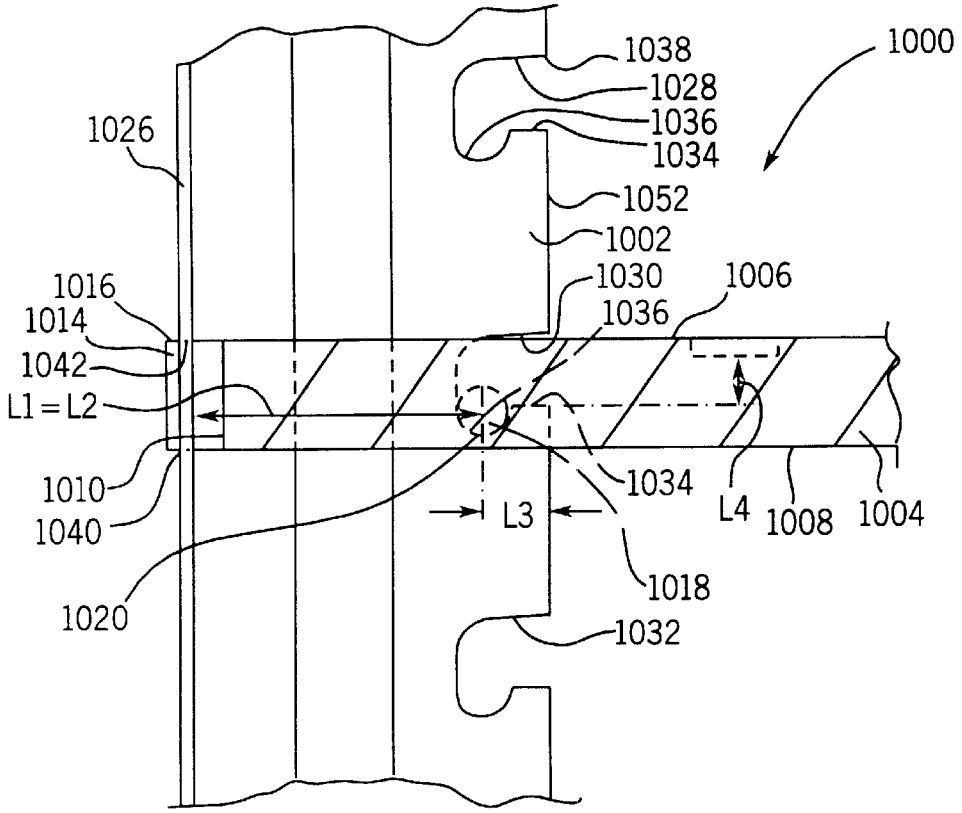
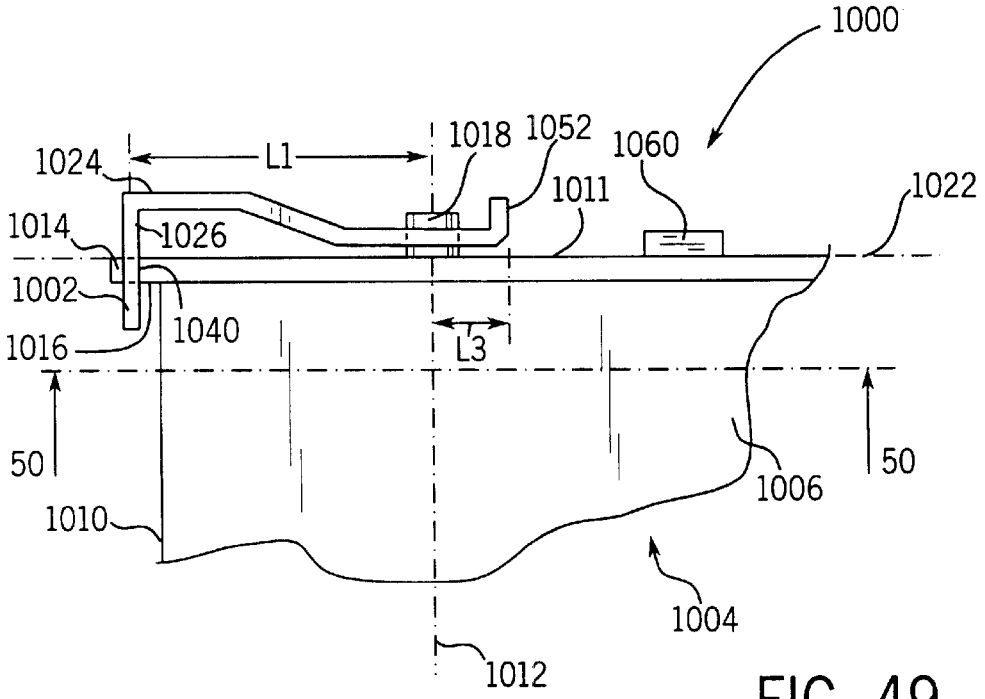
FIG. 49

SUPPORT AND RELATED SHELF

CROSS REFERENCE TO RELATED APPLICATIONS

This application is a continuation-in-part of U.S. patent application No. 09/336,899 entitled "SUPPORT AND RELATED SHELF" which was filed on Jun. 21, 1999 now U.S. Pat. No. 6,205,934 which was a continuation-in-part of Ser. No. 09/209,501 now U.S. Pat. No. 6,053,115 entitled SUPPORT AND RELATED SHELF which was file on Dec. 11, 1998.

STATEMENT REGARDING FEDERALLY SPONSORED RESEARCH OR DEVELOPMENT

Not applicable.

BACKGROUND OF THE INVENTION

This invention relates generally to racks and rack-type supports having horizontal planar surfaces and, more particularly, to such racks and supports of the type having removable and adjustable shelves.

A wide variety of racks and rack-type supports are known. Examples of but a few types are disclosed in U.S. Pat. Nos. 1,805,989 (Levene), 1,990,756 (Saaf), 5,127,340 (Maro et al.) and 5,607,070 (Hellyer). While these arrangements have been generally satisfactory for their intended purposes, they are not without disadvantages for certain applications.

For example, the shelves disclosed in the Levene patent must be bolted in place and unbolted to be removed and, if desired, stored. Where time has value, as is usually the case in a work environment, the arrangement is cumbersome. While the shelves disclosed in the Saaf patent may be more quickly mounted and removed, that convenience requires a shelf having pins mounted for pivoting movement into and out of supporting holes.

For greatest flexibility in erection, use and "tear-down, a scaffold should have a shelf-like platform which can be readily mounted and, just as readily, removed. Home entertainment centers, another type of product having one or more shelves, are most preferably configured so that the vertical spacing between shelves can be selected consistent with the vertical height of the components, e.g., tuner, compact-disc player, amplifier or the like, which are intended to rest upon such shelves. Structures like that disclosed in the Levene patent do not lend themselves easily to such uses.

Another type of rack with one or more shelves is embodied as mounted or freestanding units used to display retail products for sale. Such units are often referred to in the industry as "store fixtures." Most preferably, store fixtures should be aesthetically attractive, permit easy reconfiguration for displaying any of a variety of types of products and have features easily adapted to integration of advertising graphics or the like.

U.S. Pat. No. 5,816,419 describes one display-type shelving unit which includes a plurality of shelves mounted to laterally spaced posts. Each shelf is mounted using two special brackets which cooperate with slots and recesses in the shelf to support the shelf in a horizontal position, to hang the shelf in an essentially vertical position, or to maintain the shelf in an angled position. While this solution facilitates quick and easy movement of each shelf among its three possible positions, this solution does not enable shelf removal, facilitate changing the vertical positions of each shelf and facilitate various other useful shelving arrangements.

Yet another product which advantageously includes one or more flat surfaces having adjustable height includes a flat-surface desk which may be used by multiple persons. For example, in factories which have more than one shift, often persons who use a desk during different shifts are different heights. To comfortably accommodate users having various heights it is advantageous to have an adjustable-height desk top.

An improved support and shelf which responds to the needs described above would be an important advance in this field of technology.

OBJECTS OF THE INVENTION

It is an object of the invention to provide an improved support and shelf which addresses problems and shortcomings of the prior art.

Another object of the invention is to provide an improved support and shelf arrangement which can be quickly reconfigured.

Another object of the invention is to provide an improved support and shelf arrangement which permits rapid mounting and de-mounting of a shelf. To this end, an ideal shelving unit should facilitate essentially unobstructed shelf mounting and removal.

Yet another object of the invention is to provide an improved support and shelf arrangement which permits self-storing" of a shelf.

Another object of the invention is to provide an improved support and shelf arrangement which, in particular embodiments, involves a store fixture.

One other object is to provide an extremely strong shelving unit which can withstand relatively large weight.

Yet another object is to provide a shelving system wherein, when one shelf is hanging in a stored position, other shelves may be moved vertically with respect to the stored shelf without disturbing the stored shelf.

One more object is to take advantage of the surfaces of a stored shelf for various secondary purposes such as advertising, changing the appearance of a shelving unit, mounting of a mirror and so on.

A further object is to provide a shelving system wherein the vertical position of a shelf, the extending direction (i.e. forward or rearward) of the shelf and the direction in which surfaces face, can easily be modified.

Another object of the invention is to provide a shelving system wherein shelves can be supported in any of several different positions including several different positions that define angles with respect to a horizontal plane.

One more object of the invention is to provide a shelf assembly wherein, when a shelf is mounted to a frame member in a vertical position a shelf edge can be received within a bracket of a supportable member such as a hang bar so that the hang bar is useable as a display device.

How these and other objects are accomplished will become apparent from the following descriptions and from the drawings.

SUMMARY OF THE INVENTION

The invention involves the combination of a shelf having a longitudinal axis and an end surface coincident with such axis. It also involves an apparatus for supporting the shelf at such end surface. In the improvement, the shelf includes first and second support pins extending from the end surface in a direction parallel to the axis and defining a first spacing dimension. The apparatus includes a support member having first and second slots, each with a pin-support portion. A clearance region is between such pin-support portions and between the slots.

The clearance region has first and second boundaries and the second slot includes a pivot portion. Such pivot portion and the first boundary define a second spacing dimension slightly greater than the first spacing dimension.

More specifically, the pin-support portion of the first slot is shaped to conform to the shape of the first support pin. And the second pin is arcuate as is the pivot portion of the second slot. In a highly preferred embodiment, the support member is vertical and when the first and second support pins are in registry with the pin-support portions of the first and second slots, respectively, the shelf extends along a substantially horizontal plane.

As to other relationships of components of the new combination, when the second support pin is in registry with the pivot portion of the second slot, the shelf is angled with respect to the horizontal plane. And when such second support pin is in registry with the pivot portion of the second slot and when the shelf is angled with respect to the horizontal plane, the first support pin is spaced below the pin-support portion of the first slot.

In a specific embodiment suitable for self-storing of shelves on the support member, the apparatus has a third slot spaced below the first slot and a fourth slot spaced below the second slot. When the second support pin is in registry with the pivot portion and the shelf is angled with respect to the horizontal plane, e.g., perpendicular to such plane, the first support pin is in the fourth slot.

And the new combination of the shelf and support apparatus has yet additional features when further combined with a hang bar. More specifically, the shelf has an edge defining an edge dimension or thickness between top and bottom shelf surfaces, the top and bottom surfaces forming first and second limiting surfaces, respectively. The hang bar has a mounting bracket including a bridge member and first and second oppositely facing panels and first and second extension members extending from first and second ends of the bridge member. The first and second extension members form third and fourth limiting surfaces. The hang bar also includes a body member (e.g., notched bar) linked or secured to the bracket. The first and second extension members define a bracket dimension slightly greater than the edge thickness. When the shelf edge and hang bar mounting bracket are so configured, the hang bar may be mounted securely on the shelf by slipping the mounting bracket downwardly over the shelf edge such that the third and fourth limiting surfaces bear against the first and second limiting surfaces.

A particular embodiment of the invention is configured as a store fixture having plural shelves on which products, e.g., dry goods, may be displayed for sale. Such a store fixture has an upright frame with first and second end stanchions. First and second lateral support members fixed with respect to the frame and, specifically, are fixed with respect to the first and second stanchions, respectively. Each support member has a plurality of vertically spaced slot sets, each slot set including first and second slots. Each of the first and second slots of each slot set has a pin-support portion and a clearance region is between the slots.

A plurality of shelves is mounted between the support members and each shelf has a longitudinal axis and a pair of spaced end surfaces coincident with such axis. Each shelf end surface has first and second support pins extending axially from it. The support pins at each end surface of each shelf define a first spacing dimension.

Further, each of the clearance regions has first and second boundaries and each of the second slots includes a pivot portion. As to the first lateral support member, the pivot portions of each of its second slots and its first boundary define a second spacing dimension slightly greater than the first spacing dimension.

The new store fixture is preferably configured to permit storing, out of sight, unused shelves. Such fixture includes a storage section between the lateral support members. The storage section has a pair of spaced wall members extending between the stanchions. In the preferred fixture, there is at least one support device, e.g., a shelf-like "rail" or the like, extending between and affixed to the wall members. The wall members and the support device form an elongate storage tunnel for receiving a shelf therein for storage.

The fixture also has an end closure mounted for movement with respect to the frame, thereby permitting the storage tunnel to be opened and closed. Most preferably, the end closure is mounted for pivoting movement about a vertical axis and includes an exterior panel formed of a material which is either translucent or transparent so that light can be transmitted therethrough. An interior panel supports a lamp, the light from which is visible through the exterior panel.

And that is not all. The preferred new store fixture also has, in addition to the back lighted exterior panel, other features permitting use of visual graphics. The spaced wall members also define a vertically-oriented gap between them. An aesthetically pleasing closure member is atop the gap. There is a sign board mounted for vertical movement with respect to the closure member, thereby configuring the sign board to be displayed above the closure member or received in the gap for storage.

The invention also includes a support apparatus for use with a rigid frame member, the apparatus including at least one shelf member having a longitudinal axis and an end surface coincident with the axis, a first coupler pair including first and second couplers mounted to the end surface and a second coupler pair including third and fourth couplers mounted to the frame member within a coupling plane, the second pair delineating at least one clearance region within the coupling plane, the couplers operative to selectively mount and dismount the shelf member to the frame member. The couplers include first and second pins and first and second slot delineators, the first and second delineators defining first and second pin support surfaces and forming first and second passageways from the first and second support surfaces, respectively, each passageway wide enough for one of the pins to pass through.

When the shelf member is mounted to the frame member, the pins are essentially parallel to the axis, the passageways defining paths which are essentially perpendicular to the axis, are within the coupling plane and which open into the clearance region. With the first and second pins received on the first and second support surfaces, respectively, the shelf member is supported in a first position and the paths are essentially perpendicular to the axis, within the coupling plane and open into the clearance region so that the shelf member is dismountable from the frame member by moving the shelf member perpendicular to the axis such that the pins pass through the paths and the first and second couplers pass into the clearance region.

In one embodiment the first and second pins are connected to the frame member. In the alternative, the first and second pins are connected to the shelf member.

In one embodiment, the third and fourth couplers are upper couplers and the apparatus further include a lower coupler pair including lower third and fourth couplers which are identical to the upper third and fourth couplers and which are mounted to the frame member vertically below the third and fourth couplers, respectively, such that the second coupler pair and the lower coupler pair are operative to support the shelf member in a second position vertically below the first position with the first and second pins received on lower coupler support surfaces, respectively, the clearance region defining at least one clearance path within the coupling plane between the second and lower coupler pairs which is wide enough for the first and second couplers to pass through.

Also, the apparatus may include a hanging delineator which forms a hanging surface and a hanging pin, one of the hanging surface and hanging pin linked to the shelf member and the other of the hanging surface and hanging pin linked to the frame member, when the shelf member is mounted to the frame member, the hanging surface and hanging pin essentially parallel to the axis and within the coupling plane and, wherein, the hanging delineator and hanging pin are operative to mount and support the shelf member in an essentially vertical position with the hanging pin received on the hanging surface.

In one embodiment one of the delineators forms the hanging surface, and one of the coupler pins forms the hanging pin. In one embodiment the upper third coupler is one of the hanging delineator or the hanging pin and the upper and lower third couplers are vertically spaced such that, when the shelf member is supported in the vertical position, each of the first and second pins is received within a separate one of the third delineators. Also, each of the coupler pins may be operative as a hanging pin.

The second coupler pair couplers may be separated by the clearance region, the coupler mounted to the shelf member which is operative along with second coupler pair for hanging purposes may be a hanging coupler and, the hanging coupler may be operative with the upper third coupler to support the shelf member in the vertical position on a first side of the clearance region wherein the vertical position is an aft position.

The shelf member may be a first shelf member, the apparatus further including at least a second shelf member mountable and dismountable to the frame member, the first and second shelf members dimensioned such that, when the first shelf member is in the vertical position and the couplers mounted to the second shelf member are within the clearance region, the clearance region forms a path such that as the second shelf member is moved vertically past the first shelf member, the first shelf member is outside a shelf path swept by the second shelf member.

The hanging coupler may also be operative with the upper fourth coupler to support the shelf member in a fore vertical position on a second side of the clearance region. The hanging coupler may also be operative with the lower third coupler to support the shelf member in a third vertical position on the first side of the clearance region and may also be operative with the lower fourth coupler to support the shelf member in a fourth vertical position on the second side of the clearance region.

The apparatus may further include a hanging delineator which forms a hanging surface and a hanging pin, one of the hanging surface and hanging pin linked to the shelf member and the other of the hanging surface and hanging pin linked to the frame member, when the shelf member is mounted to the frame member, the hanging surface and hanging pin essentially parallel to the axis and within the coupling plane and, wherein, the hanging delineator and hanging pin are operative to mount the shelf member in an essentially vertical position, with the shelf member in the vertical position and the hanging pin received on the hanging surface, the shelf member supported in the vertical position.

The shelf member may be a first shelf member, the apparatus further including a second shelf member and the hanging surface and the hanging pin may be positioned such that when the first shelf is supported in the vertical position, the second shelf may be supported in the horizontal position by the second coupler pair.

In one embodiment the frame member includes a rear end and a fore end, the shelf member include first and second oppositely facing surfaces, the vertical position is a first vertical position wherein the first surface faces the fore end and, wherein, the hanging surface and the hanging pin are also operative to support the shelf member in a second vertical position wherein the second surface faces the fore end.

In one aspect the shelf member includes oppositely facing first and second surfaces, in first position the first surface faces upwardly and, wherein, the couplers are also operative to mount the shelf member to the frame member in a second position wherein the second surface faces upwardly, to this end, the first and second delineators form third and fourth pin support surfaces which face in directions opposite the first and second pin support surfaces, respectively, when in the second position, the first and second pins received on the third and fourth support surfaces, respectively.

In one embodiment, the shelf member includes fore and aft oppositely facing edges and, the first and second couplers are mounted to the end surface adjacent the fore edge.

The apparatus may include a plurality of second coupler pairs vertically spaced below the third and fourth couplers, each second coupler pair operative in conjunction with the first coupler pair to support the shelf member in a distinct position. The coupler pairs may be equispaced along the frame member.

In another aspect one of the delineators is a pivot delineator which forms a pivot zone, the coupler in the same pair as the pivot delineator being a first non-pivot coupler, the pin which is received by the pivot delineator being a pivot pin and the coupler in the same pair as the pivot pin being a second non-pivot coupler, wherein, the pivot delineator and the first non-pivot coupler are spaced and the pivot pin and the second non-pivot coupler are spaced such that when the pivot pin is inside the zone, the shelf member is rotatable from the first position to an essentially vertical position about the pivot pin such that the non-pivot coupler on the frame member is outside a path swept by the non-pivot coupler on the shelf member.

In yet another aspect the shelf member includes a brace member and a wall member, the brace member including a base member and two lateral members extending in the same direction form opposite ends of the base member, the wall member traversing the distance between the lateral members, the brace member formed of a first material and the wall member formed of a second material, the first material being more rigid than the second material, the first and second couplers mounted to the brace member.

In one embodiment, the frame member is a first frame member, the apparatus further includes a second frame member which forms a second essentially vertical frame surface, a second coupling plane parallel to the second frame surface, the end surface is a first end surface and the shelf member forms a second end surface, the first and second end surfaces facing in opposite directions. In this embodiment, the apparatus further includes a third coupler pair including fifth and sixth couplers connected to the second end surface and a fourth coupler pair including seventh and eighth couplers connected to the second frame member, the fourth pair delineating a second clearance region within the second coupling plane, the couplers including third and fourth pins and third and fourth slot delineators, the third and fourth delineators defining third and fourth pin support surfaces, respectively. The third and fourth delineators form third and fourth passageways from the third and fourth support surfaces, respectively, each passageway wide enough for one of the pins to pass through. When the shelf member is mounted to the brace members, the pins essentially parallel to the axis, each of the third and fourth passageways defining third and fourth paths which are essentially perpendicular to the axis, are within the second coupling plane and which open into the second clearance region. When the shelf member is mounted to the frame members in the first position, the third and fourth pins are received on the third and fourth support surfaces, respectively, the third and fourth paths are essentially perpendicular to the axis, within the second coupling plane and opening into the second clearance region so that the shelf member is dismountable from the frame member by moving the shelf member perpendicular to the axis such that the third and fourth pins pass through the third and fourth paths and the fifth and sixth couplers pass into the second clearance region.

In another aspect the first and third coupler pairs form a shelf dimension and at least a portion of the first clearance region and a section of the seventh coupler closest to the portion form an egress dimension wherein the egress dimension is greater than the shelf dimension. In one embodiment the first clearance region forms a recess which is large enough to receive the first coupler pair and extends opposite the second frame member and wherein the portion is formed within the recess.

In another embodiment the first frame member forms a lateral opening in the first clearance region, the lateral opening having dimensions which are greater than the dimensions of the shelf member.

In yet another embodiment the first and third coupler pairs form a shelf dimension and each of the fourth and eighth frame members forms an opening large enough for the first and third coupler pairs to pass through, respectively, to dismount the shelf.

In another aspect the frame member includes a front end and a rear end, the third and fourth couplers are front third and fourth couplers connected to the front end and the apparatus further includes rear third and fourth couplers connected to the rear end to selectively link and de-link the shelf member to the rear end in another position wherein the shelf member is precluded from downward movement.

In one embodiment, a storage space separates the front and rear ends. Also, preferably, the apparatus further includes first and second spaced wall members separated by the storage space, and the first and second walls form an elongate storage tunnel and wherein the apparatus further includes an end closure mounted for movement with respect to the frame member, thereby permitting the storage tunnel to be opened and closed.

In one other embodiment the third coupler is a first third coupler and the apparatus further includes a second third coupler which is vertically spaced with respect to the first third coupler. In this embodiment, the first, second and fourth couplers and the first third coupler are juxtaposed such that the couplers can support the shelf member in a second position which is different than the first position. In one embodiment, the first third coupler forms the first support surface and the second third coupler forms another support surface, the fourth coupler forms the second support surface and the first and second couplers are pins. When the shelf member is in the second position, one of the pins bears against the second support surface and the other of the pins bears against the another support surface. Preferably there are several third couplers vertically spaced with respect to the first third coupler and any of at least a subset of the third couplers may cooperate with the first, second and fourth couplers to support the shelf member in an angled position.

The invention further includes a support apparatus for use with a rigid frame member, the apparatus including a coupler pair including forward and rearward couplers mounted to the frame member, a shelf assembly including a shelf member having a planar surface, a longitudinal axis and an end surface coincident with the axis, a first coupler mounted to the end surface and cooperating with one of the forward and rearward couplers to mount the shelf member to the frame member for rotation about a first rotation axis and a support assembly including a support member having an end surface and a second coupler mounted to the end surface, the second coupler cooperating with the other of the forward and rearward couplers to mount the support member to the frame member for rotation about a second rotation axis, the support member also having at least first and second support surfaces which are essentially parallel to the second rotation axis, the first support surface being a first distance from the second rotation axis and the second support surface being a second distance from the second rotation axis wherein the first and second distances are different. In this embodiment, with the support member and the shelf member mounted to the frame member, the support member can support the shelf member in a first position wherein the planar surface is supported by the first support surface and in a second position wherein the planar surface is supported by the second support surface.

Yet another embodiment of the invention includes at least one shelf member, a rear extending member, an end extending member and an essentially upright frame member. In this embodiment, the shelf member has a longitudinal axis, an end surface essentially perpendicular to the axis and a rear surface essentially parallel to the axis. The rear extending member is mounted to and extends from the rear surface essentially perpendicular to the axis, a top surface of the rear extending member forming a first bearing surface. The end extending member is mounted to and extends from the end surface essentially parallel to the axis. A bottom surface of the end extending member forms a second bearing surface. A first plane is parallel to the end surface and passes through the second bearing surface such that the first and second bearing surfaces define a first dimension therebetween within the first plane. The essentially upright frame member includes a first wall and a second wall that form an angle. The first wall forms an opening delineator that in turn forms a third bearing surface and a passageway that opens to form an egress in a direction opposite the second wall. The passageway is wide enough that the end extending member can pass therethrough. The second wall forms a rear coupler, a downwardly facing surface of the rear coupler forming a fourth bearing surface. A second plane is essentially parallel to the first wall and the third and fourth bearing surfaces define an essentially horizontal second dimension in the second plane that is equal in length to the first dimension. In this embodiment, the shelf member may be operatively mounted to the frame member in a horizontal position wherein the first bearing surface bears against the fourth bearing surface and the second bearing surface bears against the third bearing surface.

In one embodiment a rear section of the shelf member forms the rear extending member and a top surface of the shelf member forms the first bearing surface. In another embodiment the delineator of the first delineator in the rear coupler forms a second opening delineator that receives the rear extending member. In yet another embodiment the rear coupler forms a frame extending member that extends toward the delineator.

In one aspect the first wall may form a distal edge adjacent the egress and opposite the second wall such that distal edge and third bearing surface define a third essentially horizontal dimension. In this embodiment the shelf member may form a limit extension that extends from the end surface essentially parallel to the end extending member, an extending member surface facing in the direction opposite the rear surface forming a hanging surface and the limit extension and hanging surface defining a fourth dimension perpendicular to the first dimension and in the first plane wherein the third and fourth dimensions are essentially identical.

The apparatus may further include a second essentially upright frame member including at least a third wall essentially parallel to the first wall, the shelf member forming a second end surface that faces in the direction opposite the first end surface. In this case, a second end extending member may be mounted to and extend from the second end surface essentially parallel to the axis. A bottom surface of the second end extending member may form an additional second bearing surface, the first and additional second bearing surfaces defining the first dimension in a third plane parallel to the second end surface and passing through the additional second bearing surface, the third wall forming a second opening delineator. An upward facing surface of the second delineator may form an additional third bearing surface and the second delineator may also form a passageway that opens to form another egress in a direction opposite the rear coupler. The passageway should be wide enough that the second end extending member may pass therethrough. The fourth and additional third bearing surfaces define the essentially horizontal second dimension and a fourth plane parallel to the third wall.

In yet another aspect the second frame member may also include a fourth wall essentially perpendicular to the third wall. The rear coupler may be a first rear coupler and the apparatus may also include a second rear coupler. Also the rear extending member may be a first rear extending and the apparatus may include a second rear extending member extending from the rear surface adjacent the second end surface. A top surface of the second rear extending member may form an additional second bearing surface, a downwardly facing surface of the second rear coupler forming an additional fourth bearing surface. The additional first and additional second bearing surfaces may define the first dimension with the third plane and the additional third and additional fourth bearing surfaces may define the second dimension with the fourth plane.

Other details of the invention are set forth in the following detailed description and in the drawings.

BRIEF DESCRIPTIONS OF THE DRAWINGS

FIG. 1 is a perspective view of a store fixture with shelves erected for product display, with both end closures closed and with a sign board in the lowered position;

FIG. 2 is a perspective view of a store fixture generally like that of FIG. 1 but with an end closure open, the sign board in the raised position and with hang bar supports and mounting brackets installed in place of shelves;

Figure 3:
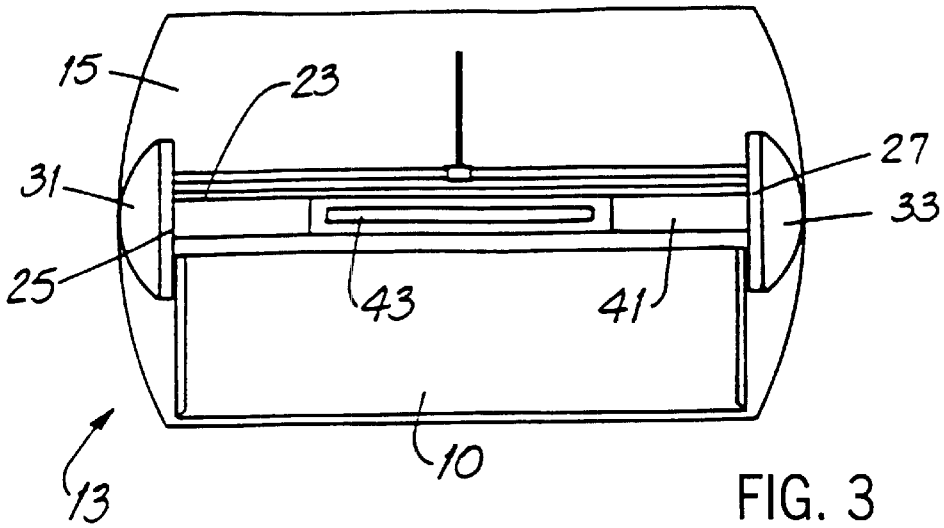
FIG. 3 is a top plan view of the store fixture of FIG. 1.
Figure 4:
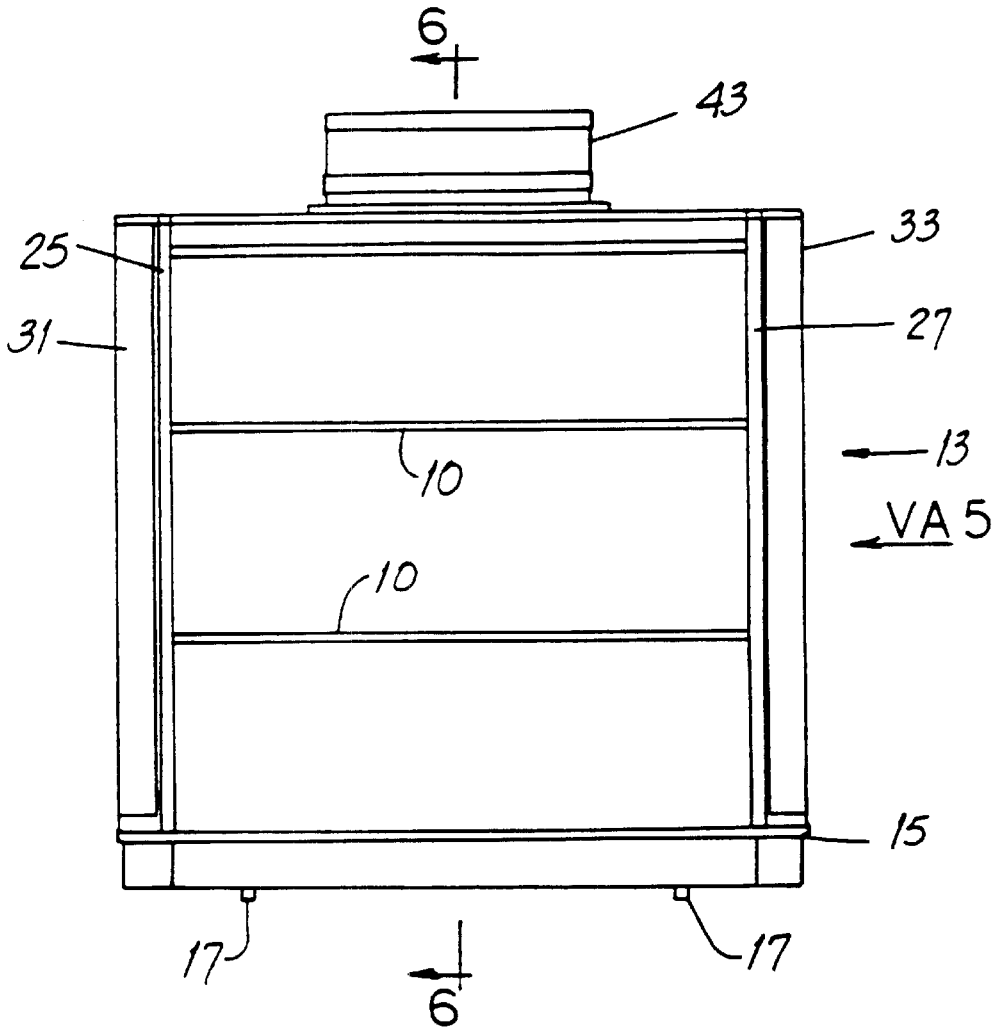
FIG. 4 is a front elevation view of the store fixture of FIG. 1 with the sign board raised.
Figure 6:
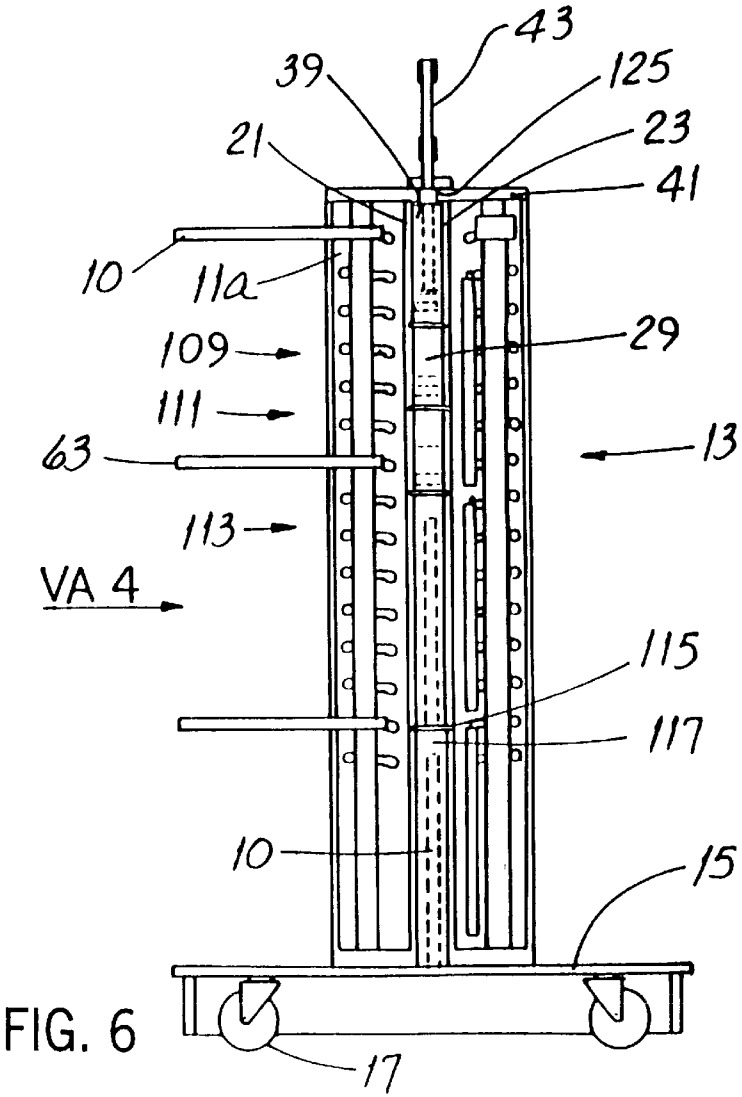
FIG. 6 is a sectional view of the store fixture of FIG. 4 taken along the viewing plane 6—6 thereof.
Figure 5:
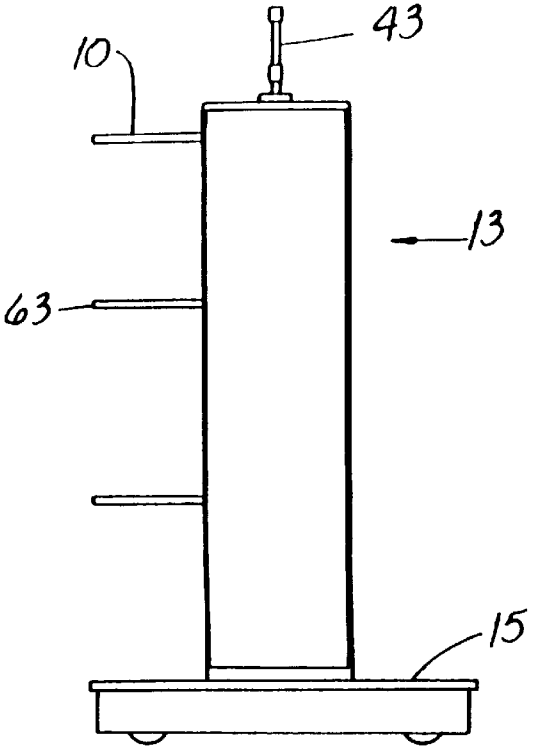
FIG. 5 is an end elevation view of the store fixture of FIG. 4 taken along the viewing axis VA5 thereof.
Figure 7:
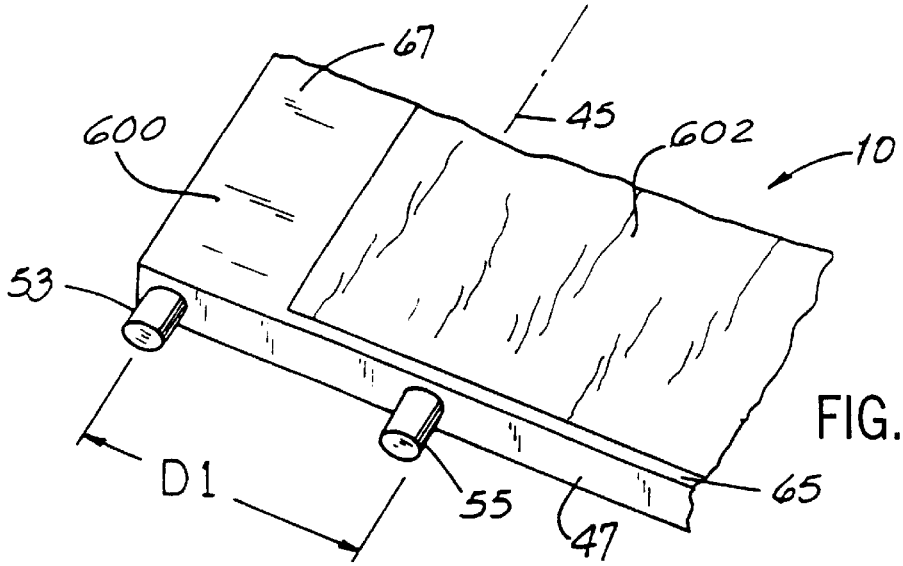
Figure 8:
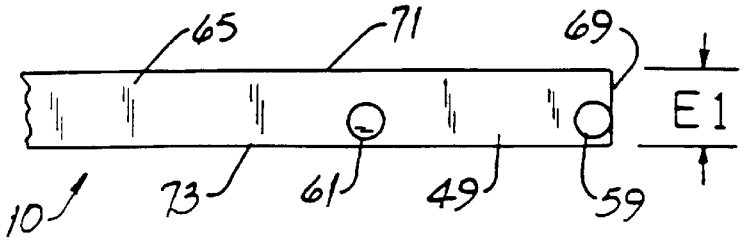
Figure 9:
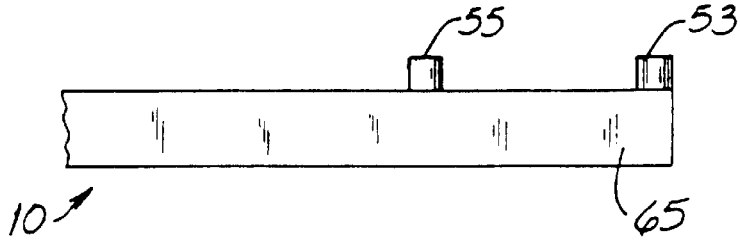
Figure 10:
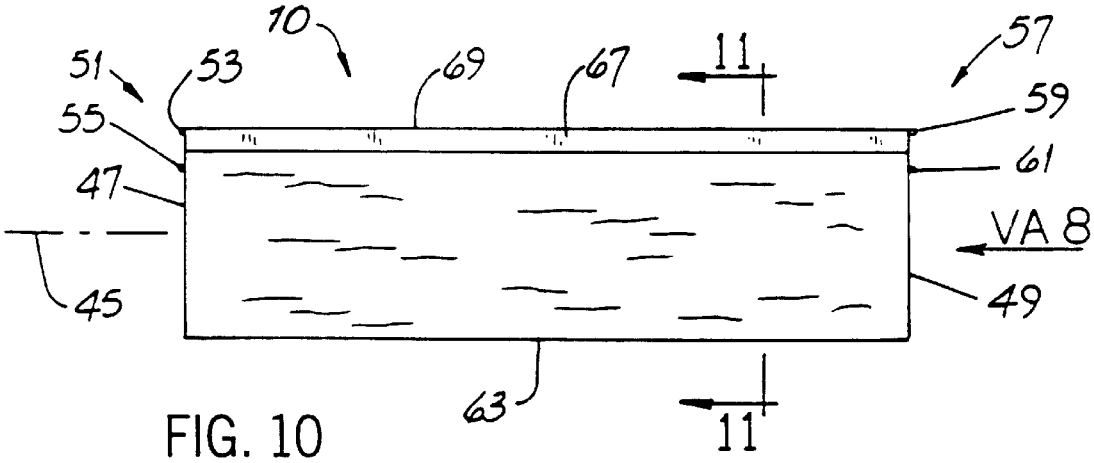
Figure 7A:
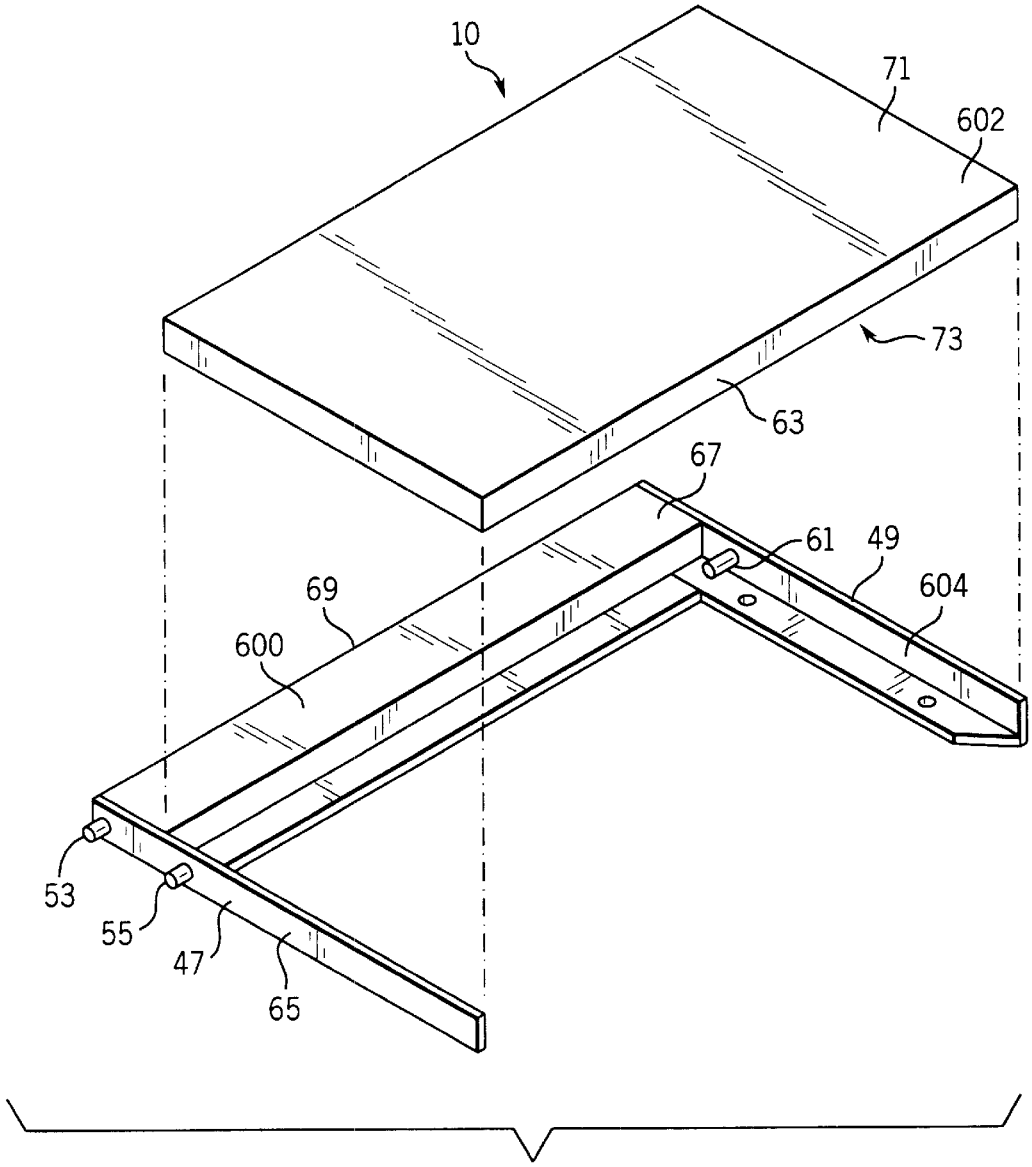
Figure 12:
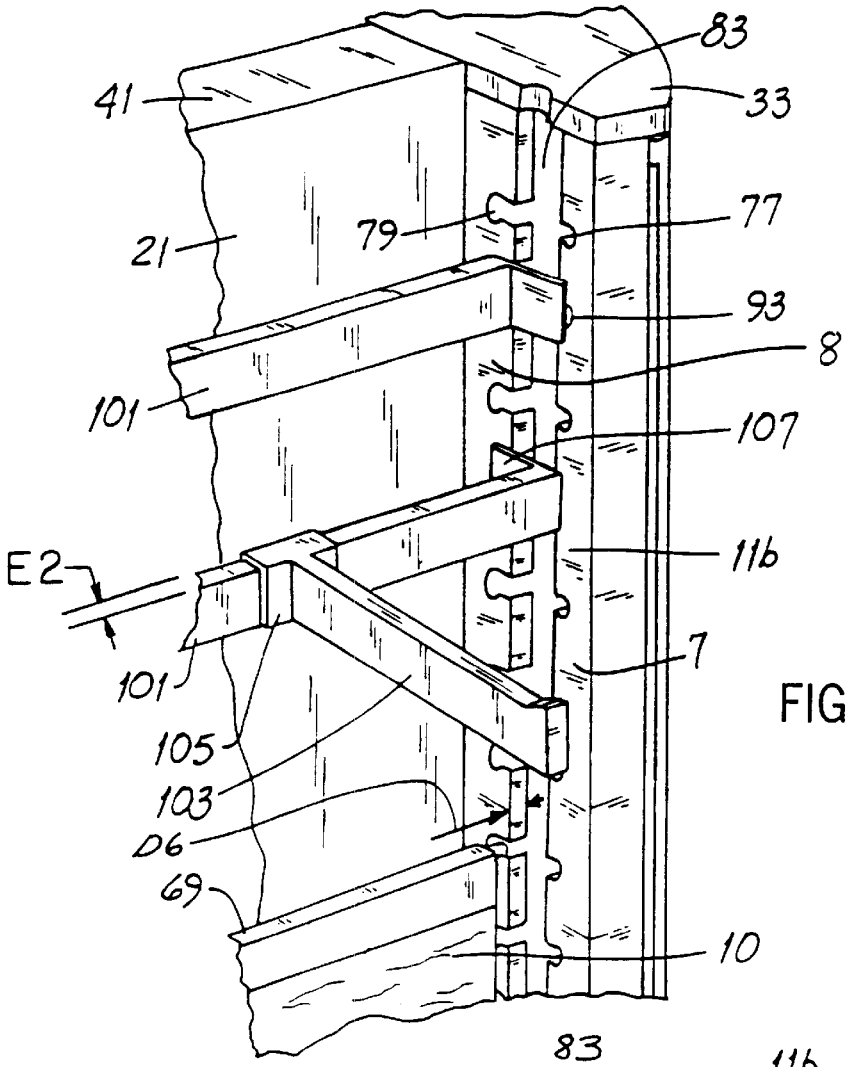
Figure 13:
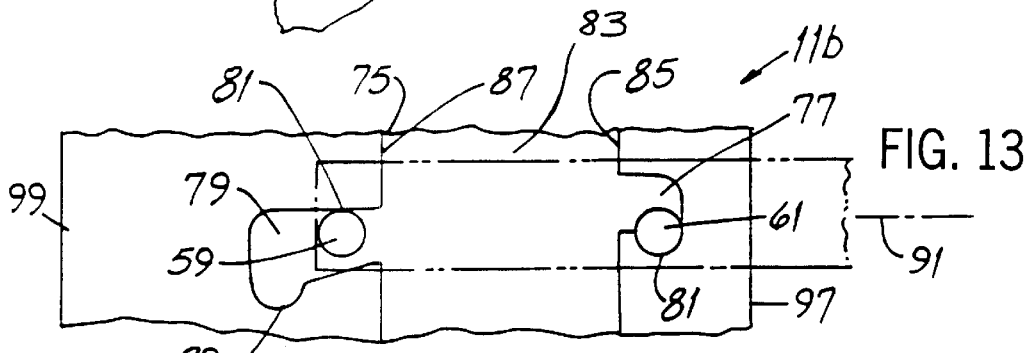
Figure 16:
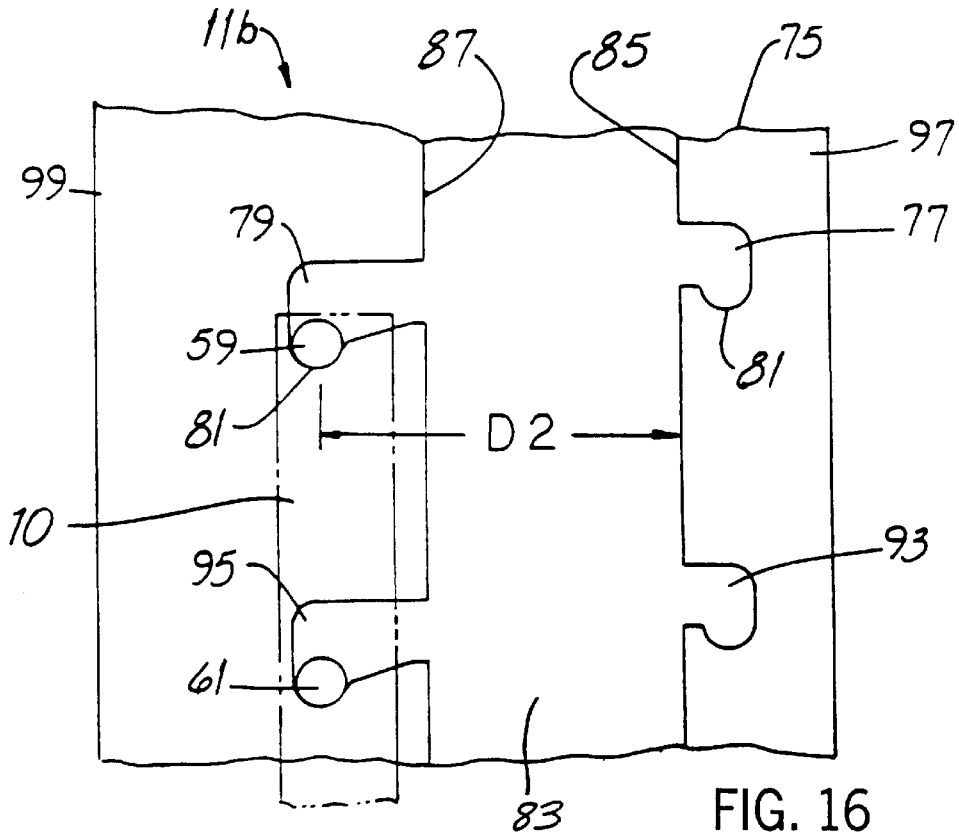
Figure 19A:
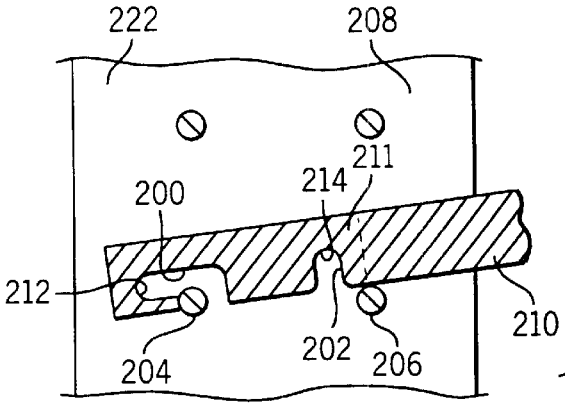
Figure 19B:
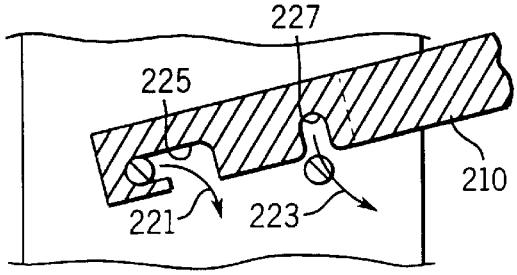
Figure 19C:
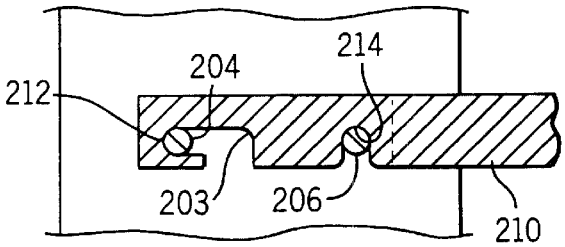
Figure 19D:
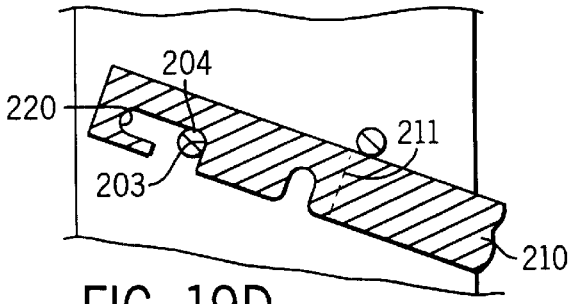
Figure 19E:
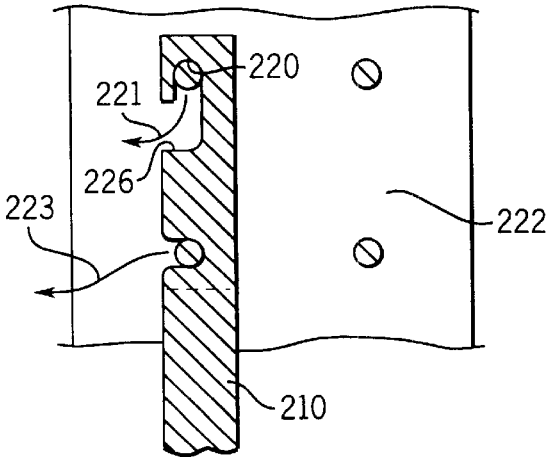
Figure 20:
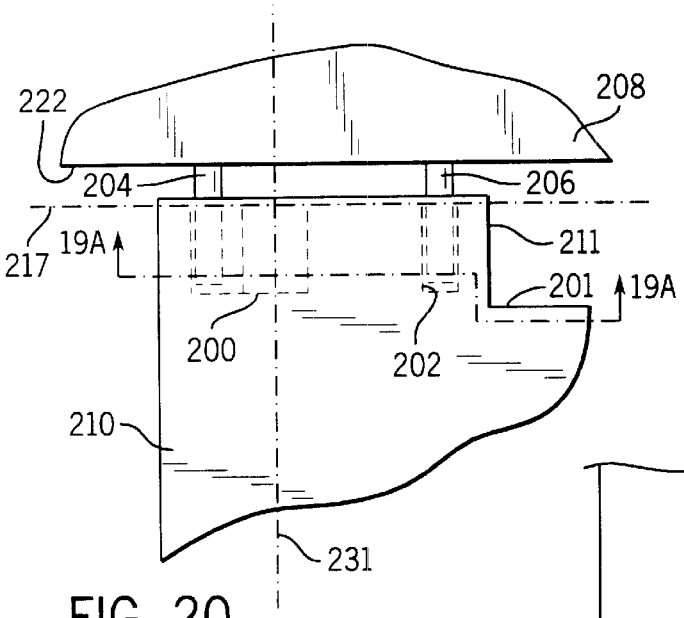
Figure 21:
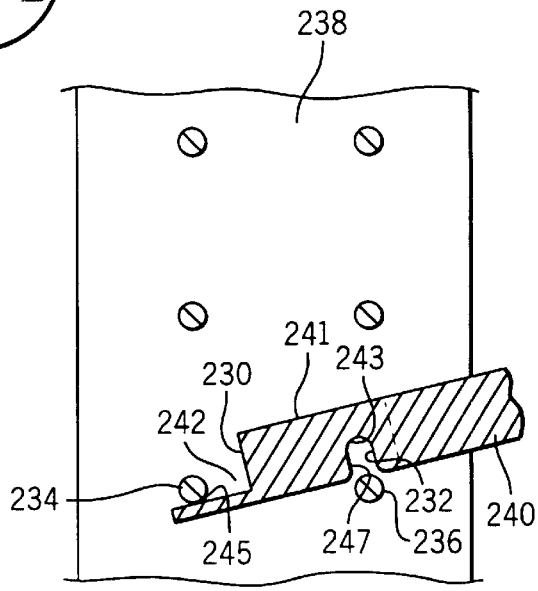
Figure 22:
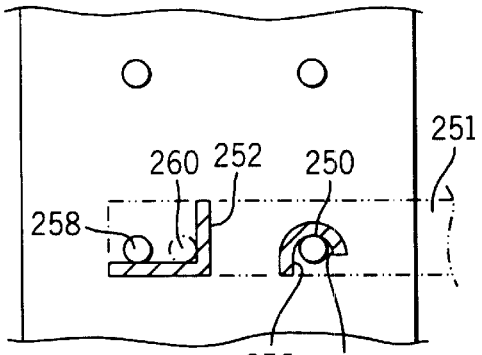
Figure 23:
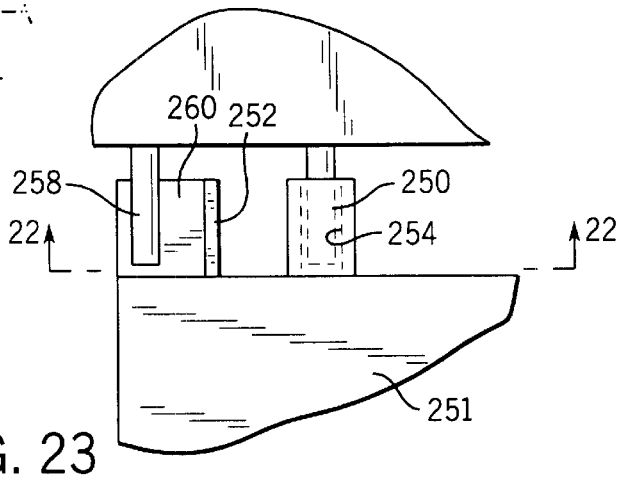
Figure 31:
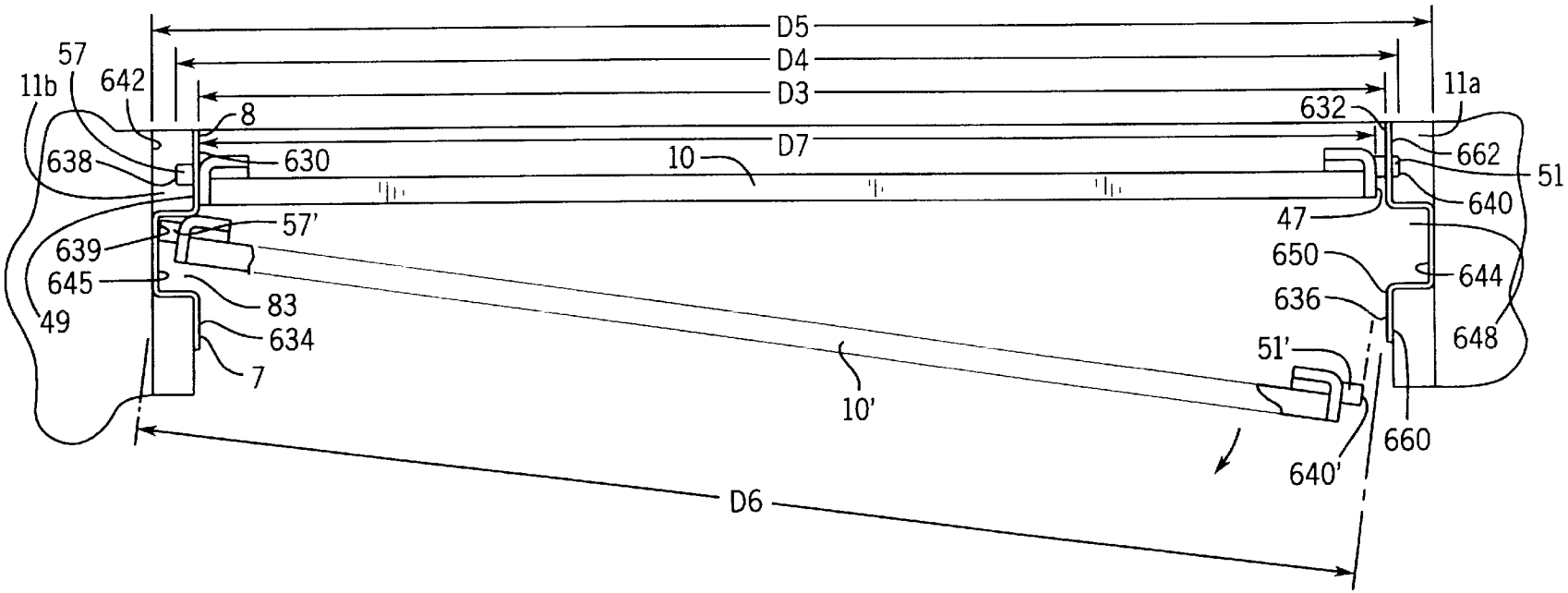
Figure 35:
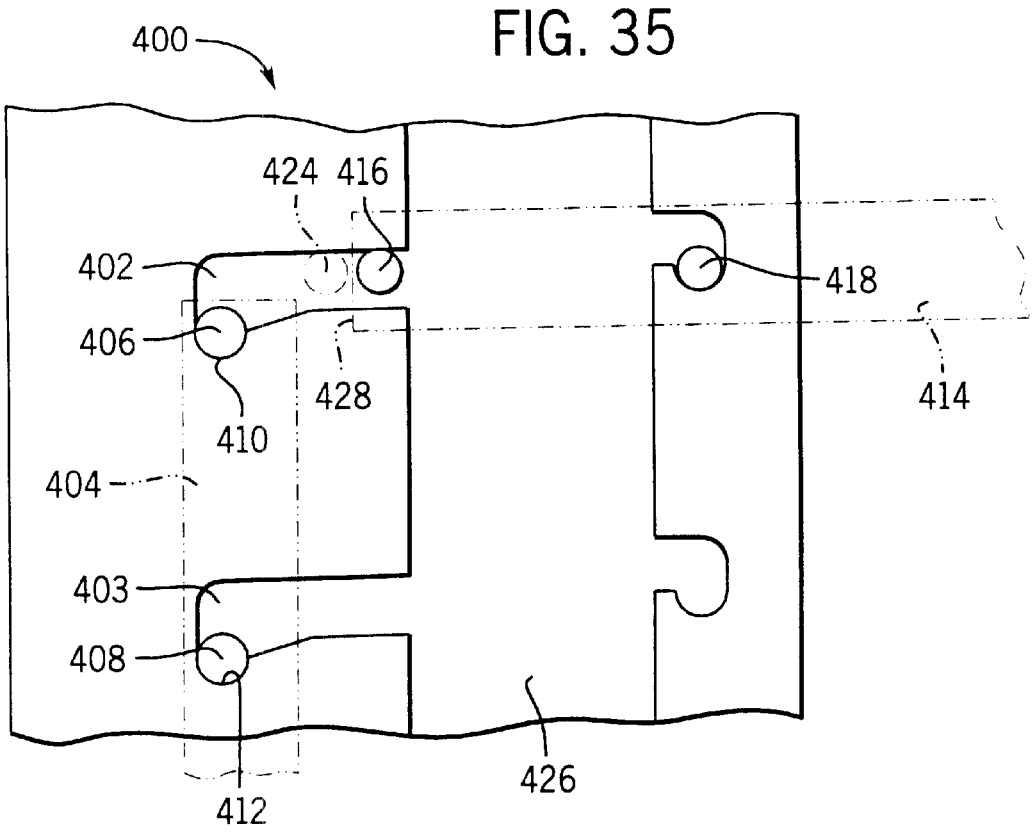
Figure 36:
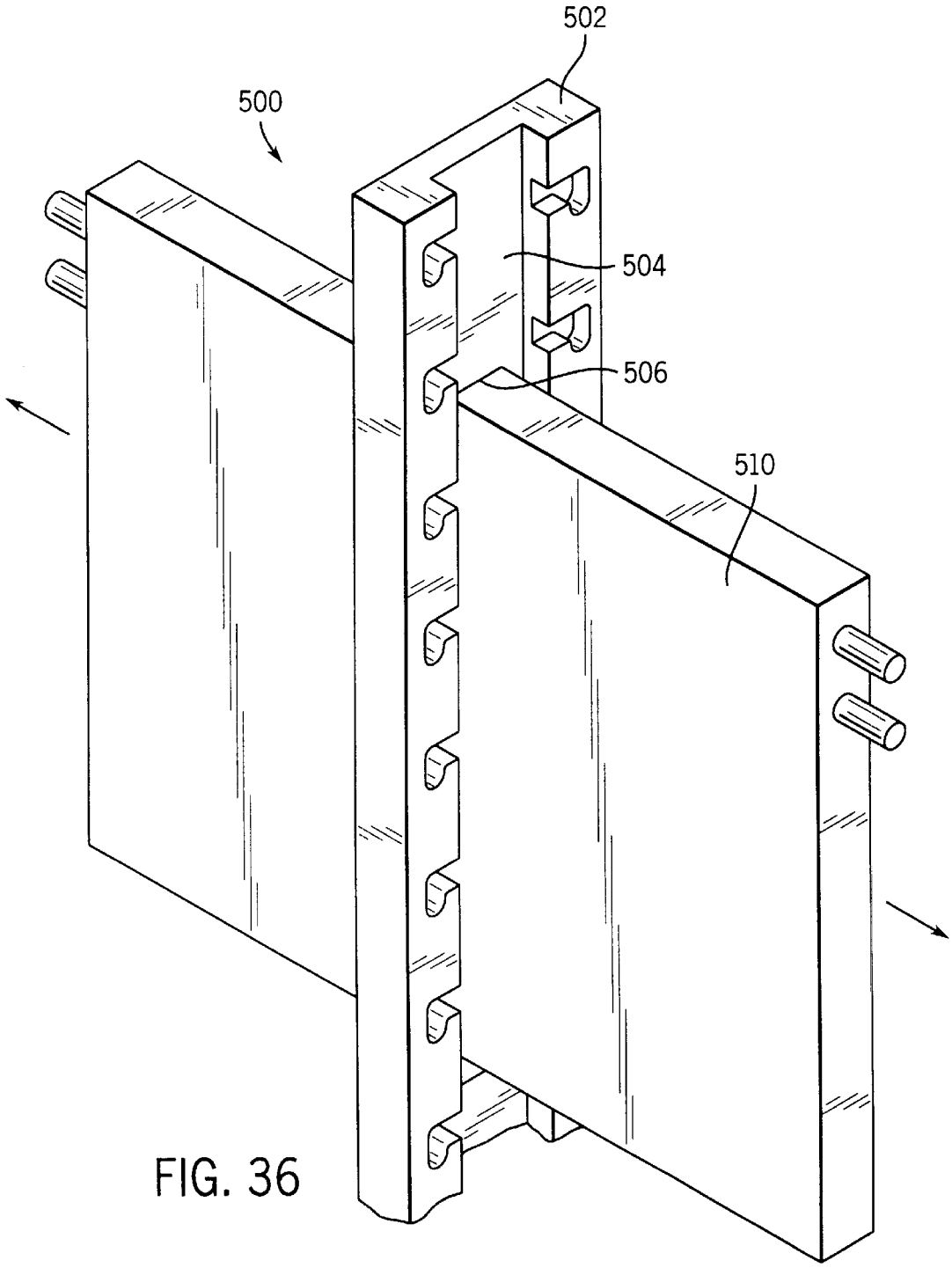
Figure 41:
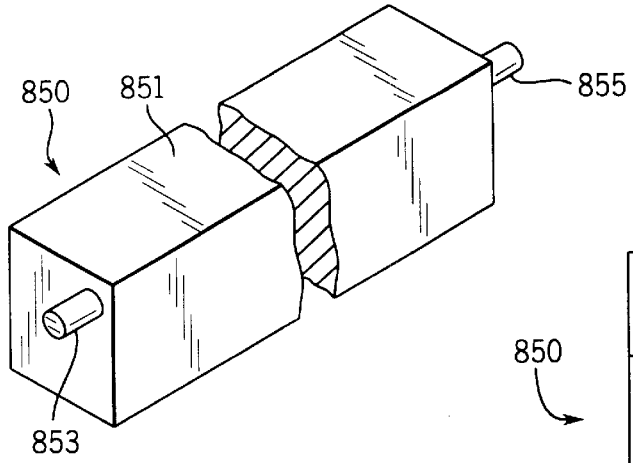
Figure 42:
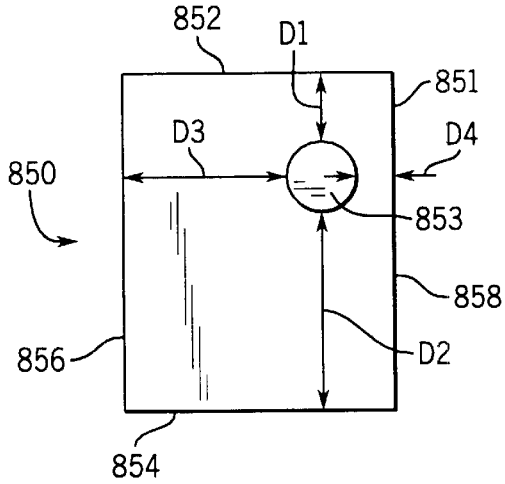
Figure 43:
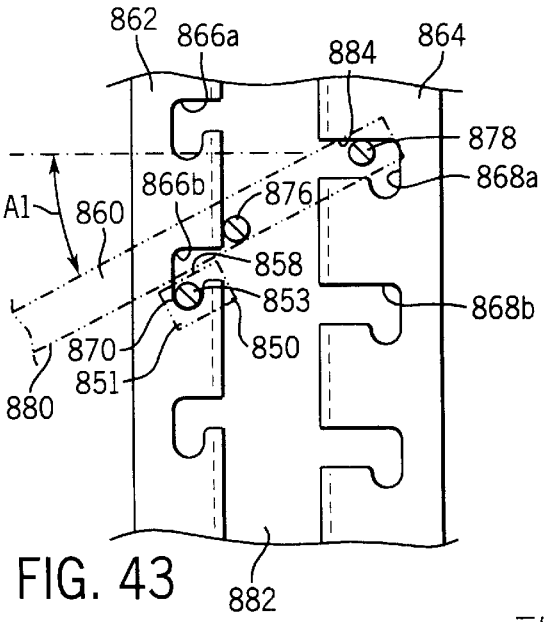
Figure 44:
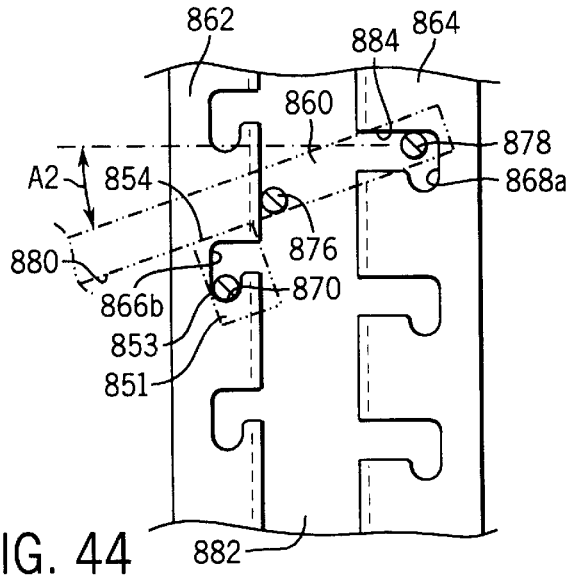
Figure 45:
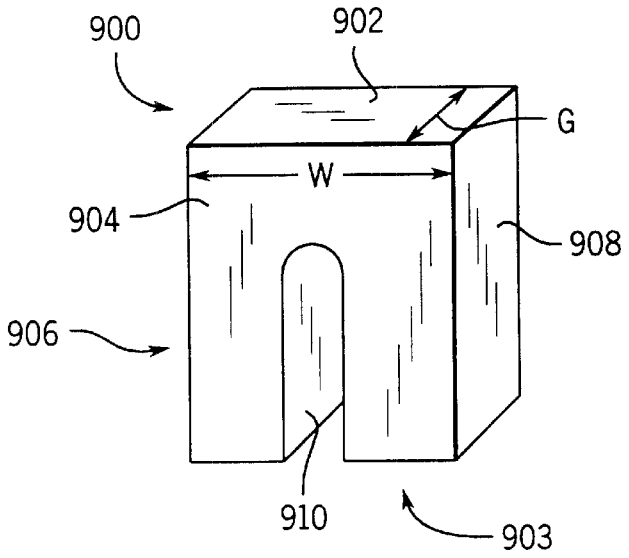
Figure 46:
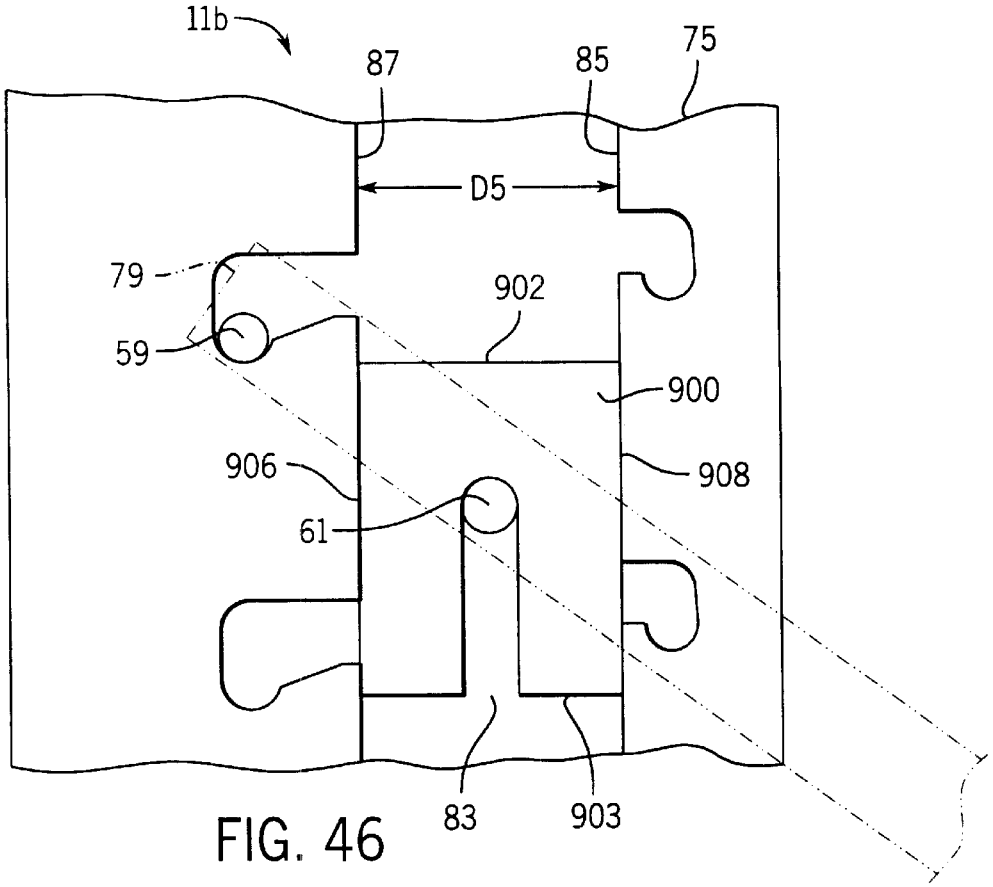
Figure 47:
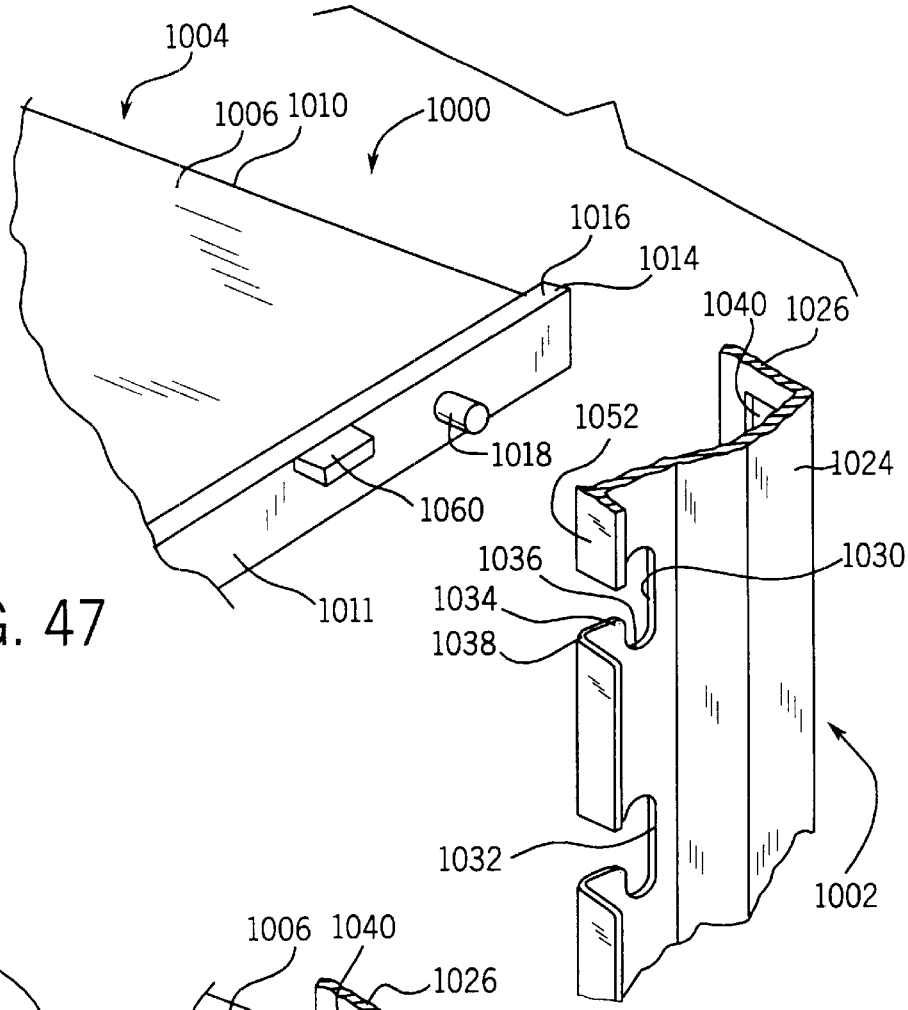
Figure 48:
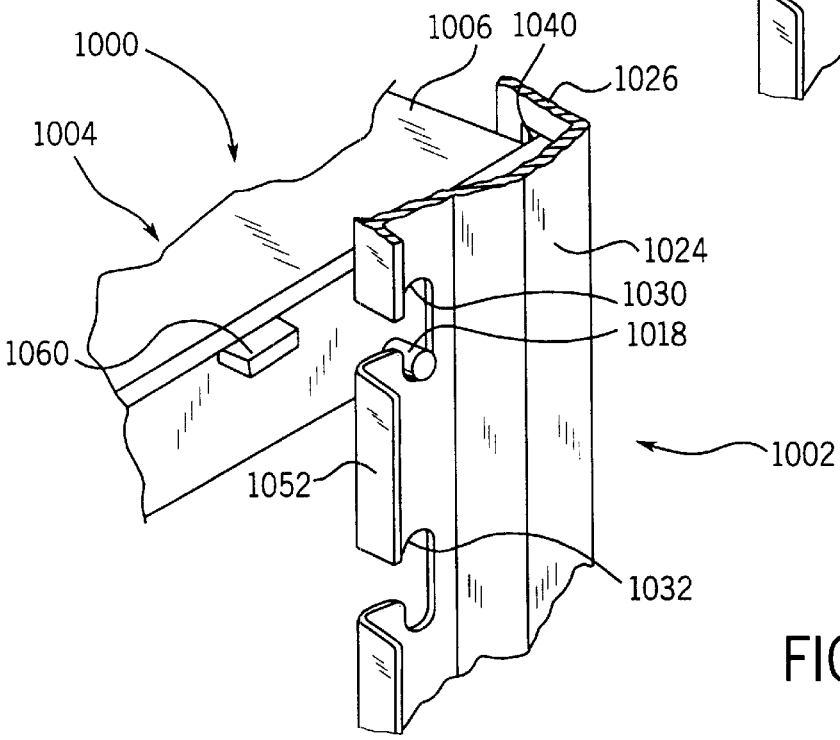
Figure 51:
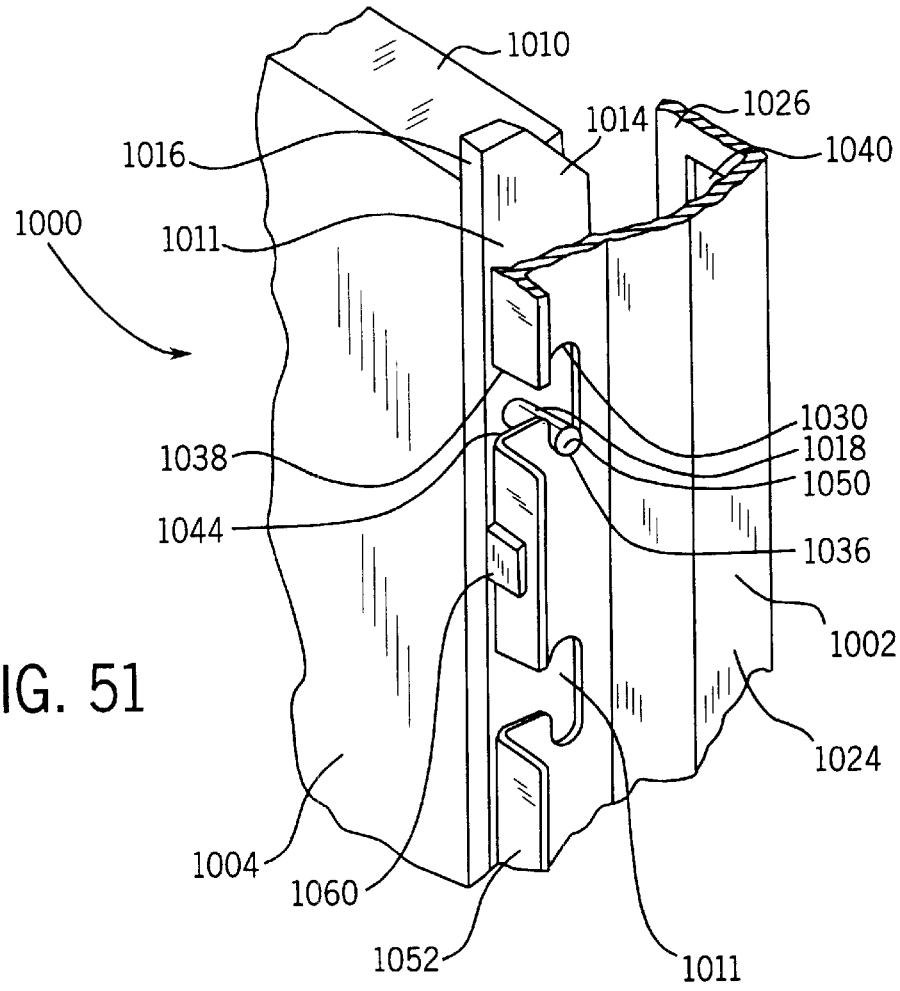
Figure 52:
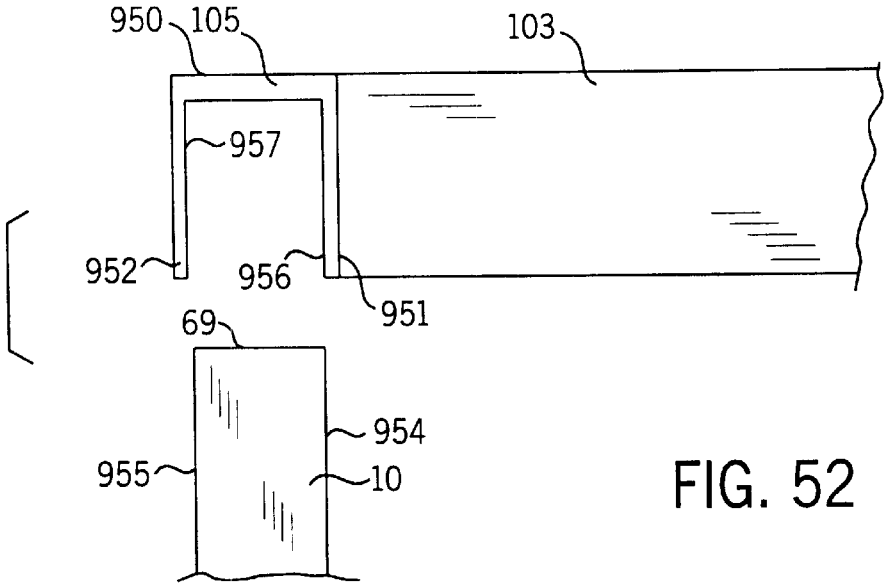
Figure 53:
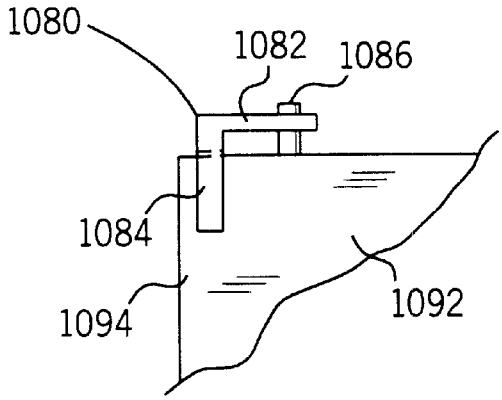
Figure 54:
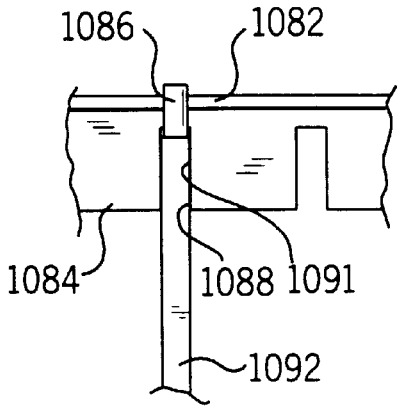
Figure 55:
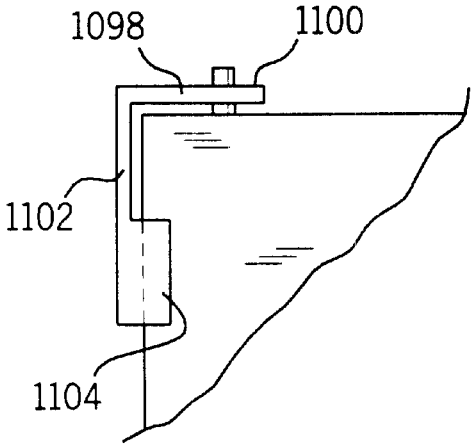
Figure 56:
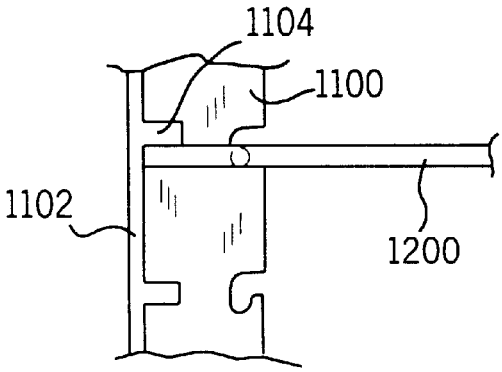
Figure 57:
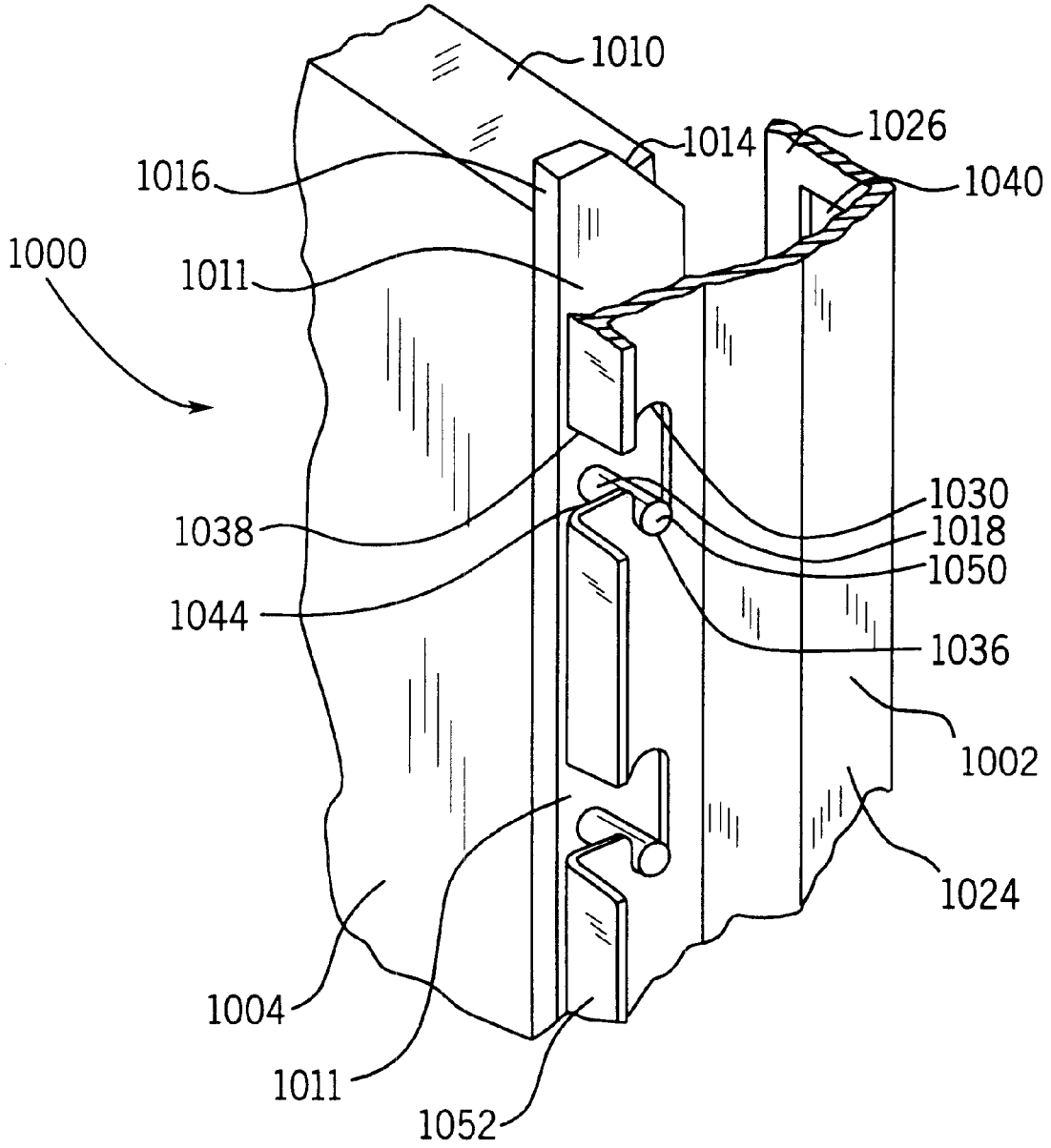

FIG. 7A, perspective views of a shelf used in the store fixture of FIGS. 1 through 6. Parts are broken away;

FIG. 8 is an end view of the shelf of FIGS. 7 and 10 taken along the viewing axis VA8 of FIG. 10. Parts are broken away;

FIG. 9 is a top plan view of a portion of a metal edge member used in the shelf of FIG. 7. Parts are broken away;

FIG. 10 is a top plan view of the shelf of FIG. 7;

FIG. 11 is a section view of the shelf of FIG. 10 taken along the viewing plane 11—11 therof;

FIG. 12 is a perspective view of a portion of the store fixture. Parts are broken away;

FIGS. 13, 14, 15 and 16 show, in solid outline, one of the two shelf support apparatus used in the store fixture. Sequential positions of a shelf are shown in dashed outline in such FIGS.;

FIG. 17 is a downwardly looking section view of one of the store fixture end closures;

FIG. 18 shows, in dashed outline, another embodiment of a support apparatus having slot locations differing from the slot locations shown in, e.g., FIGS. 13–16. Another embodiment of a shelf and two of its support pins are shown in solid outline and parts of the shelf are broken away;

FIGS. 19A–19E illustrate a second embodiment of the present invention wherein a shelf member is in several different positions with respect to a frame member views taken along the line 19A—19A of FIG. 20;

FIG. 20 is a top plan view of a shelf/frame member coupling assembly;

FIG. 21 is an illustration similar to that of FIG. 19B, albeit of a third embodiment of the present invention;

FIG. 22 is an illustration similar to that of FIG. 19C, albeit of a fourth embodiment of the present invention which is taken along the line 22—22 of FIG. 23;

FIG. 23 is a top plan view similar to the view of FIG. 20;

FIG. 24 is a view of a fifth embodiment of the present invention which is similar to the view of FIG. 22;

FIG. 25 is a schematic diagram of a sixth preferred embodiment of the present invention with a shelf member in a first horizontal position;

FIG. 26 is similar to FIG. 25, albeit with the shelf member positioned in a second horizontal position;

FIG. 27 is similar to FIG. 26, albeit with the shelf member in an aft downward vertical position;

FIG. 28 is similar to FIG. 27, albeit with the shelf member in a fore downward vertical position;

FIG. 29 is similar to FIG. 27, albeit with the shelf member in an aft upward vertical position;

FIG. 30 is similar to FIG. 29, albeit with the shelf member in a fore upward vertical position;

FIG. 31 is a top plan view of an inventive shelving assembly;

FIG. 32 is a front plan view of a second embodiment of the inventive shelving assembly;

FIG. 33 is a plan view of a third embodiment of the inventive assembly;

FIG. 34 is a fourth embodiment of the inventive assembly;

FIG. 35 is a view similar to the view of FIG. 16, albeit of another embodiment of the invention;

FIG. 36 is a perspective view of yet another embodiment of the present invention;

FIG. 37 is a view of yet another embodiment similar to the view of FIG. 13 with a shelf illustrated in a horizontal supported position;

FIG. 38 is similar to FIG. 37, albeit with the shelf supported in a first angled position;

FIG. 39 is similar to FIG. 38, albeit with the shelf supported in a second angled position;

FIG. 40 is similar to FIG. 38, albeit with the shelf supported in yet another angled position;

FIG. 41 is a perspective view of a support bar assembly according to the present invention;

FIG. 42 is an end view of the assembly of FIG. 41;

FIG. 43 is a view similar to the view of FIG. 13, albeit illustrating the support bar of FIG. 41 supporting a shelf in a first angled position;

FIG. 44 is similar to FIG. 43, albeit with the bar assembly supporting a shelf in a second angled position;

FIG. 45 is a perspective view of an angle support;

FIG. 46 is a view similar to the view of FIG. 16, albeit with the support of FIG. 45 supporting a shelf in an angled position;

FIG. 47 is a perspective view of yet another embodiment of the present invention;

FIG. 48 is a view similar to FIG. 47, albeit with a shelf member mounted in a horizontal position to a frame member;

FIG. 49 is a top plan view of the shelf member and frame member of FIG. 48;

FIG. 50 is a partial cross-sectional view taken along the line 50—50 of FIG. 49;

FIG. 51 is a perspective view similar to FIG. 48, albeit with the shelf member mounted to the frame member in a vertically supported position;

FIG. 52 is a side view of a shelf and supportable member or hang bar member of FIG. 12;

FIG. 53 is a top elevational view of another embodiment of the present invention showing a shelf member mounted in a horizontal position to an upright frame ember;

FIG. 54 is a front elevational view of the assembly of FIG. 53;

FIG. 55 is yet another embodiment of the present invention shown in top elevational view;

FIG. 56 is a side elevational view of the assembly of FIG. 55;

FIG. 57 is similar to FIG. 51, albeit showing a slightly different embodiment.

DETAILED DESCRIPTIONS OF PREFERRED EMBODIMENTS

Referring first to FIGS. 1 through 10, aspects of the invention involve a shelf 10 (i.e. a shelf member which is also generically referred to herein as a "brace member") and apparatus 11 for supporting the shelf 10 at each brace member or shelf end surface. The invention will be described in connection with an embodiment involving a store fixture 13. The overall arrangement of the fixture 13 will be described first and this is followed by more detailed descriptions of specific features.

The fixture 13, shown in FIGS. 1 through 6, includes a generally planar base 15 optionally equipped with casters 17 for easy relocation from place to place. A frame 19 (i.e. a frame member) is rigidly affixed to and extends vertically upwardly from the base 15. The frame 19 includes substantially flat first and second wall members 21 and 23, respectively. While a single wall member may be used, two spaced-apart wall members are preferred for reasons that will become apparent.

The frame 19 also includes lateral support members configured as first and second end stanchions 25 and 27, respectively. Each of the wall members 21, 23 extends between and is rigidly affixed to the stanchions 25, 27.

Conveniently, the fixture 13 has a storage section 29 which, when considered from left to right, is between the stanchions 25, 27. Considered from front to rear, such section 29 is between the wall members 21, 23.

At least for reasons of better aesthetics, the storage section 29 is covered by first and second end closures 31, 33, respectively. Most preferably, such closures 31, 33 are pivot mounted to the first and second end stanchions 25, 27, respectively, and swing open and closed along vertical axes 35, 37, respectively. The end closures 31, 33 are preferably configured to include backlighting and/or some sort of graphic treatment as a sales aid, both as further described below.

The spaced wall members 21, 23 define a vertically oriented gap 39 between them and an aesthetically pleasing closure member 41 is atop the gap 39 for gap closure. The fixture 13 has a sign board 43 mounted for vertical movement with respect to the closure member 41, thereby configuring the sign board 43 to be pulled upwardly and displayed above the closure member as shown in FIG. 2 or depressed downwardly and received in the gap 39 for storage as shown in FIG. 1. Details of the shelf 10 and shelf support apparatus 11 will now be set forth.

Referring to FIGS. 7 through 11 and 7A, the shelf 10 has a longitudinal axis 45 and first and second substantially flat end surfaces 47, 49, respectively, which are coincident with axis 45 and perpendicular thereto. In addition, shelf 10 forms fore and aft oppositely facing edges 63, 69, respectively. Shelf 10 has a first pair 51 of support pins, (i.e., pins 53 and 55) (also referred to as first and second couplers forming a first coupler pair), extending from the first end surface 47. Similarly, shelf 10 has a second pair 57 of support pins, (i.e., pins 59 and 61) (also referred to as fifth and sixth couplers forming a third coupler pair), extending from the second end surface 49. As to those pins comprising one of the pairs, (e.g., pair 51 including pins 53 and 55), such pins are also referred to herein as first and second pins 55, 53, respectively. (As to a particular pair 51 or 57, the pin 55 or 61 closer to the shelf outward or fore edge 63 is identified as the first pin.) The pins 53, 55, 59, 61 extend in directions parallel to the axis 45 and as to those pins comprising the first or third pair, (e.g., pins 53 and 55), such pins define a first spacing dimension D1.

Referring particularly to FIGS. 7, 7A, 8, 9 and 11, a highly preferred shelf 10 includes a U-shaped brace member 600 and a wall member 602. Brace member 600 includes a base member 67 and two lateral members 65, 604 which extend in the same direction from opposite base member 67 ends.

Wall member 602 traverses the distance between lateral members 65, 604 and includes a top or first surface 71 and an oppositely facing bottom or second surface 73. Wall member 602 and brace member 600 are fastened together in any manner (e.g. glue, mechanically or by any other means well known in the art). Preferably brace member 600 is formed of a strong rigid material (e.g. steel, aluminum, etc.) while wall member 602 is formed of a lightweight relatively strong material (e.g. particle board, wood laminate, etc.). This construction provides an extremely strong shelf 10 which is relatively light weight and inexpensive to produce.

Each pair of pins (e.g. pair 51) is integral with one of the metal edge members 65 or 604. The end surfaces 47, 49 are those of respective edge members 65, 604. Stiffener or base member 67 extends along an aft edge 69 (opposite fore edge 63) of shelf 10 which is rearward when the shelf 10 is erected for product display. As shown in FIG. 8, the stiffener or base member 67 defines an edge dimension E1 and the significance of such dimension E1 is further described below.

Considering FIGS. 8 and 10, it is apparent that as to a particular pair 57 of pins, (e.g., the pins 59 and 61), the shelf edge 69 is tangent to the second pin 59 and both pins 59, 61 are spaced equidistant from the shelf top surface 71 or bottom surface 73. This specific configuration is preferred for reasons relating to manufacturing expediency. However, as further described below, other pin locations are possible without departing from the spirit of the invention.

Figure 14:
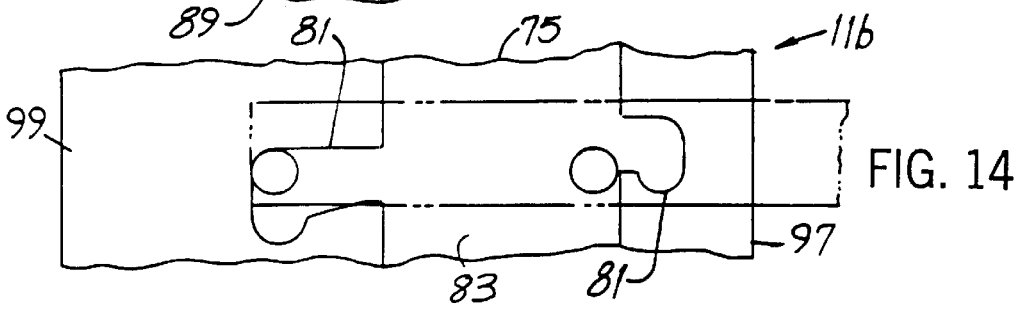

Referring next to FIGS. 6 and 12 through 16, the invention also involves a separate apparatus 11*a*, 11*b* for supporting the shelf at each end surface 47, 49. In the store fixture 13, the apparatuses 11*a*, 11*b* are mirror images of one another and are shown in FIGS. 6 and 12, respectively. Each apparatus 11*a* and 11*b* includes a front end 750 and a rear end 752, respectively (only shown with respect to apparatus 11*a* in FIG. 6). Therefore, it is necessary to describe only one of the apparatus 11*a* or 11*b* and the latter is described below. The apparatus 11*b* includes a frame or support member 75 having first and second slot delineators 7 and 8 (also referred to as second and third couplers forming a second coupler pair) which define slots 77 and 79, respectively. Referring also to FIGS. 13 and 14, each slot 77, 79 has a pin-support portion or surface 81. A rectangularly shaped, "channel-like" clearance region 83 is between such pin-support portions 81 and between the slots 77, 79. Clearance region 83 has first and second boundaries 85 and 87, respectively, and the second slot 79 includes a pivot portion or pivot zone 89. As shown in FIG. 16, such pivot portion 89 and the first boundary 85 define a second spacing dimension D2 slightly greater than the first spacing dimension D1.

Referring now to FIG. 31, shelf 10 is illustrated in an exemplary vertically mounted position where shelf 10 is supported by frame members 11*a* and 11*b*. Shelf 10 is also shown in phantom and identified as 10' in a dismounted position which facilitates shelf removal. Dismounted shelf 10' includes pin pairs 51' and 57' and a pin end 640' . Delineators 7 and 8 (i.e. the second coupler pair) extend from a first vertical surface 642 on opposite sides of clearance region 83, each delineator 7, 8 forming a delineator edge 634, 630, respectively, which is essentially parallel to surface 642. Similar delineators 660 and 662 (also referred to herein as seventh and eighth couplers forming a fourth coupler pair) extend from a second vertical surface 644 on opposite sides of a clearance region 648, each delineator 660, 662 forming a delineator edge 636, 632, respectively, which is essentially parallel to surface 644.

FIG. 31 is a top plan view and shelf 10 is illustrated in a vertically hanging position and therefore the first coupler pair 51 (i.e. pins 53 and 55) appears as a single pin while the third coupler pair 57 (i.e. pins 59 and 61) also appears as a single pin. Ends of pairs 51 and 57 are identified by numerals 640 and 638, respectively.

Several important relative space dimensions are illustrated in FIG. 31. A third dimension D3 is the distance between facing delineator edges 630 and 632 or 634 and 636. A fourth or "shelf" dimension is the distance between pin ends 638 and 640. A fifth dimension is the distance between facing first and second vertical surfaces 642 and 644, respectively. A sixth or "egress" dimension is the distance between a portion 639 of the first clearance region 83 adjacent delineator 8 and a coupler edge 650 wherein coupler edge 650 is the edge of delineator surface 636 which is closets to portion 639. A seventh dimension D7 is the width dimension of shelf 10 from edge 47 to edge 49.

Relations between dimensions D3 through D6 are as follows. First, dimension D7 must be less than dimension D3. When so dimensioned, when shelf 10 is stored in a vertical position, shelf 10 fits between delineator surfaces 630 and 632 outside the space between clearance regions 83 and 648.

Second, dimension D4 must be greater than dimension D3 and less than dimension D5. When so dimensioned, shelf 10 can be mounted with oppositely facing pins received in delineator slots for support purposes and is not impeded by vertical surfaces 642 and 644 from movement perpendicular to the longitudinal shelf axis (i.e. the shelf length in FIG. 31).

Third, the pin-to-pin shelf dimension D4 is less than dimension D6. When so dimensioned, shelf 10 can easily be removed from members 11*a* and 11*b* by placing pin pair 57 in clearance region 83 adjacent portion 639 and swinging the opposite end 640 of shelf 10 outwardly as illustrated (ee phantom in FIG. 31). End 640' clears coupler edge 650 for removal. Although not necessary, similar dimensions may be provided between a portion of clearance region 648 and a coupler edge (not numbered) of delineator 7.

As to other aspects of the invention, the pin-support portion 81 of the first slot 77 is shaped to conform to the shape of the first support pin 61. In a specific embodiment, the pin-support portion 81 of the first slot 77 defines an arc of a circle and the first support pin 61 is circular in cross-section and has about the same radius of curvature as the portion 81 of such first slot 77.

The pivot portion 89 of the second slot 79 is arcuate as is the second pin 59. (Most preferably, the pin 59 is cylindrical.) In a highly preferred embodiment, the support member 75 is vertical and when the first and second support pins 61, 59 are in registry with the pin-support portions 81 of the first and second slots 77, 79, respectively, the shelf 10 extends along a substantially horizontal plane 91.

Figure 15:
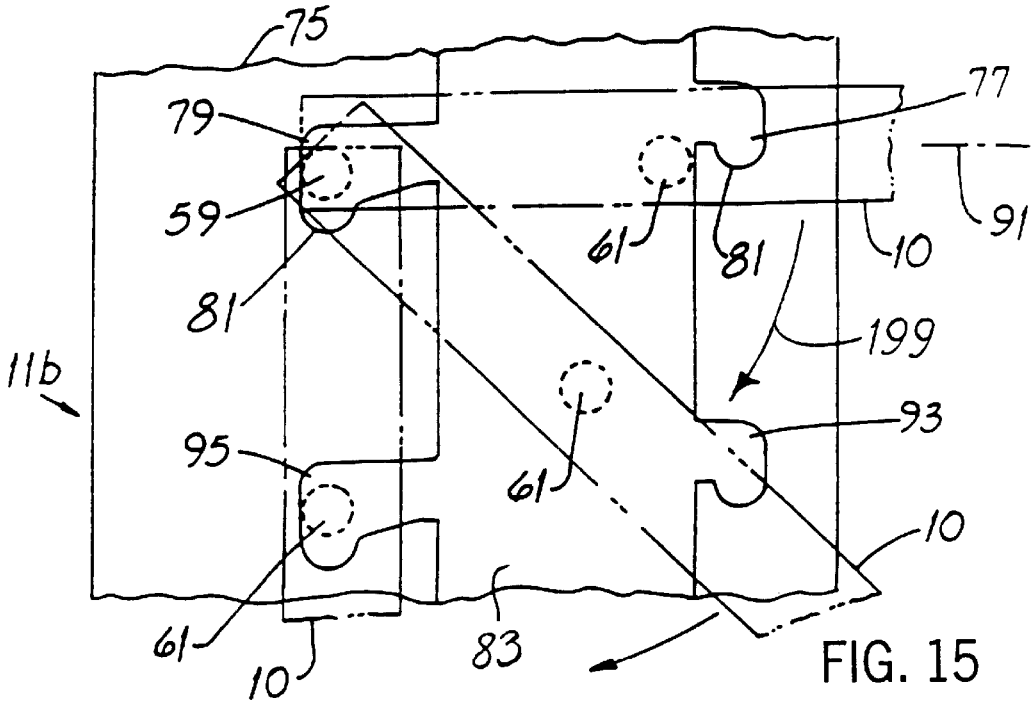

Considering FIGS. 13 through 16, and particularly FIGS. 13 and 15, when the second support pin 59 is in registry with the pivot portion 81 of the second slot 79 and when the shelf 10 is being pivoted downwardly for shelf storage or pivoted upwardly for product display, the shelf 10 is angled with respect to the horizontal plane 91. When such second support pin 59 is in registry with the pivot portion 81 of the second slot 79 and the shelf 10 is angled with respect to the horizontal plane 91 as shown in FIGS. 15 and 16, the first support pin 61 is spaced below the pin-support portion 81 of the first slot 77.

Referring to FIGS. 12, 15 and 16, a specific embodiment is suitable for self-storing shelves 10 on the support member 75. In such embodiment, the apparatus 11*b* has a lower third slot 93 (i.e., a lower third coupler) spaced below the first slot 77 (i.e., an upper third coupler) and a fourth slot 95 (i.e., a lower fourth coupler) spaced below the second slot 79 (i.e., an upper fourth coupler). When the second support pin 59 is in registry with the pivot portion 81 of slot 79 and shelf 10 is angled with respect to the horizontal plane, e.g., perpendicular to such plane 91, first support pin 61 is in fourth slot 95. To describe this configuration in less geometric terms, the first support pin 61 aligns with and swings through a shelf path 199 (ee FIG. 15) and "swings into" the fourth slot 95 and the shelf 10 is reoriented from horizontal to a self-storing vertical position. To describe it in yet other terms, the pins 59, 61 are n the slots 79, 95, respectively, and the shelf 10 "hangs" vertically from the pins 59, 61 (as well as, of course, from the pins 53, 55.)

Pin 59 about which the pivoting occurs is referred to herein as a pivot pin, the delineator 79 which forms the pivot zone in which the pivot pin 59 pivots is referred to as the pivot delineator, the coupler (e.g. 77) secured to or formed by the member which forms the pivot delineator is referred to as a first non-pivot coupler and the coupler secured to or formed by the member which forms the pivot pin is referred to generally as a second non-pivot coupler.

In addition, the pin (e.g. 59 in FIG. 16) which bears against a hanging surface for hanging purposes is also referred to as a hanging pin while the delineator or slot (e.g. 79) which forms the hanging surface is also referred to as a hanging delineator. In the embodiment of FIG. 16 each of pins 49 and 61 is a hanging pin and each of slots 79 and 61 is a hanging delineator.

Considering FIGS. 6 and 12–16, the support apparatus 11*b* may be configured in any of several different ways. In a preferred embodiment, the apparatus 11*b* has forward and rearward delineators or support strips 97 and 99, respectively. Such strips 97, 99 are separately mounted and located so that the clearance region 83 is of the desired dimension consistent with the relationship between dimensions D1 and D2 described above. However, the apparatus 11*b* may also be configured as a unitary piece which includes the support strips 97, 99 and the clearance region 83 therebetween.

Referring again to FIGS. 16 and 31, to remove shelf 10 from assemblies 11*a* and 11*b*, a user forces shelf 10 upward and then manipulates shelf 10 so that pins 59 and 61 both move toward and into clearance region 83. At the same time pin pair 51 (see FIG. 31) is also forced into clearance region 648 Next, the user places pin pairs 57 adjacent portion 639 (ee phantom in FIG. 31) and rotates the opposite shelf end (i.e., the end including pin pair 51) out of in region 648. Finally, the end of shelf 10 in region 83 is removed. Referring still to FIG. 31, while dimension D6 is preferably greater than dimension D4, most preferably dimension D6 is only slightly greater than dimension D4 so that, unless pin pair 57 is adjacent portion 639, opposite shelf end 640 will not clear coupler edge 650. When so configured, while delineators 7, 8, 660 and 662 facilitate shelf removal via affirmative and specific shelf manipulation (ee FIG. 31), the delineators also maintain a shelf within the space between clearance regions 83 and 648 unless the specific manipulation occurs thereby helping a system user maintain control of the shelf during vertical shelf movement.

In the embodiment illustrated in FIG. 31, regions 83 and 648 and edges 630, 634, 632 and 636 are similarly dimensioned so that shelf 10 may be removed in either a forward direction or a reverse direction and by removing either shelf end first. Although this commonly dimensioned design is preferred from a manufacturing perspective (i.e., identical components are less expensive to manufacture than several different types of components), assemblies 11*a* and 11*b* may include delineator and/or clearance regions which have varying dimensions and characteristics such that a shelf can only be removed from a specific location along the frame members. For example, referring to FIG. 32, another inventive embodiment 698 is illustrated which includes two shelves 10*a* and 10*b* in vertical positions with respect to frame members 11*a* and 11*b*. Member 11*a* forms a clearance region 700 while member 11*b* forms a clearance region 702. Each member 11*a* and 11*b* also forms an opening 704, 706, respectively, in their respective clearance regions 700, 702. Openings are at exactly same height and are just large enough for one of the pin pairs to pass through. Facing edges of members 11*a* and 11*b* are identified by numerals 708 and 710. Pin pairs 51*a* and 57*a* extend from opposite edges of shelf 10*a* while pin pairs 51*b* and 57*b* extend from opposite edges of shelf 10*b*.

In embodiment 698 the dimensions and juxtaposition of shelf 10*a*, pin pairs 51*a* and 57*a*, facing frame member edges 708 and 710 and clearance depths 712 and 714 are such that shelf 10*a* cannot be rotated out of the area between regions 700 and 702 as illustrated in FIG. 31. Instead, to remove a shelf in embodiment 698, the shelf must be vertically moved to the position of shelf 10*b* where pin pairs 51*b* and 57*b* are aligned with openings 704 and 706. Then shelf 10*b* can be moved forward (i.e. out of the illustration) for removal.

Referring to FIG. 33, another embodiment 720 is illustrated wherein a single shelf 10*b* is illustrated in a vertical position relative to frame members 11*a* and 11*b*. Elements of shelf 10*b* and members 11*a* and 11*b* which are identical to elements in FIG. 31 are similarly marked. The only distinction between the embodiments of FIGS. 31 and 32 is that, instead of each frame member 11*a* and 11*b* forming an opening, only frame member 11*b* forms an opening 722 for removing a shelf. To remove shelf 10*b* in embodiment 720, pin pair 57*b* is aligned with opening 722, the shelf end adjacent member 11*b* is rotated until pin pair 57*b* is free of member 11*b* and the opposite end of shelf (i.e. adjacent pin pair 51*b*) is removed. In this embodiment, as with the embodiment of FIG. 31, it is contemplated that shelf and frame member dimensions are such that shelf 10*b* cannot be removed from the area between clearance regions 700 and 702 unless shelf 10*b* is positioned so pin pair 57*b* is vertically aligned with opening 722.

Referring to FIG. 34, yet one other embodiment 730 is illustrated wherein shelf 10*b* is in a vertical position relative members 11*a* and 11*b*. Once again elements which are identical between FIGS. 31 and 32 are similarly marked. In this embodiment, instead of providing openings (e.g. 704 and 706 in FIG. 31), a recess 732 is provided in clearance region 708 which extends in the direction opposite member 11*b* and is large enough to receive pin pair 51*b*. Recess 732 forms a distal wall 705 at its deepest point. Here, the "egress" dimension is between wall 705 and edge 710 of frame member 11*b*. In embodiment 730, to remove shelf 10*b*, shelf 10*b* is vertically positioned such that pin pair 51*b* is aligned with recess 732. Then shelf 10*b* is moved laterally (e.g., to the left) so pin pair 51*b* is received within recess 732 and pin pair 57*b* is clear of edge 710. Next, the shelf edge adjacent pair 57*b* is rotated out of the space between clearance regions 700 and 702 and the shelf end adjacent pin pair 51*b* is removed.

Thus, it should be appreciated that many different frame member designs can be configured to enable shelving to be easily removed when specific affirmative manipulative steps are taken but which, when the steps are not taken, constrains shelving movement to help a user control shelving during reconfiguration. All designs having this feature are contemplated by the invention.

Some fixture users may prefer to display certain types of brackets 103 of products, e.g., neckties, purses, belts or the like, by hanging the products on hang bar brackets 103 rather than laying them upon shelves 10. Referring now to FIGS. 2, 8, 11, 12 and 52, the new combination of the shelf 10 and support apparatus 11 readily accommodates that preference. A supportable member or hang bar bracket 103 has an inverted U-shaped bar attachment member or bracket 105 defining a dimension E2 only slightly greater than shelf thickness or edge dimension E1. As seen in FIG. 52, bracket 105 includes a bridge member 950 having first and second ends (not separately labeled) and first and second oppositely facing extension members 951 and 952 that extend in the same direction from bridge member 950. In the illustrated embodiment extension members 951 and 952 are parallel and planar (see also FIG. 12). Shelf member 10 has top and bottom surfaces 954 and 955 that form first and second limiting surfaces, respectively. The facing surfaces 956 and 957 of first and second extension members 951 and 952 form third and fourth limiting surfaces, respectively. When the shelf edge 69 and bracket 103 are so configured and when the shelf 10 is in a downward, self-stored position as shown in FIGS. 12 and 16, the bracket 105 may be mounted securely on the shelf 10 by slipping the member 105 downwardly over the shelf edge 69.

When the rear edge 69 of shelf member 10 is received between members 951 and 952, surface 956 bears against surface 954 and surface 957 bears against surface 955 to support bar 103 in the upright position.

Importantly, the inventive embodiment including the hang bar 103 mounted to a dual-position (e.g., horizontal and vertical) shelf is independent of the coupler assembly arrangement type. For example, the shelf member coupler assembly may include two pins or include two slot delineators or one of each while the frame member is configured to accommodate the shelf member assembly. The inventive aspect in the case of the hang bar embodiments is that the inventors have recognized that by configuring the shelf edge with a specific thickness dimension, standard hang bars already used in the industry can be accommodated and hence an even more versatile shelving configuration can be provided.

Referring to FIGS. 1, 3, 4, 5 and 6, where the store fixture 13 preferably has plural shelves 10 on which products, e.g., dry goods, may be displayed for sale, each support apparatus 11*a*, 11*b* has a plurality of vertically spaced slot sets such as sets 109, 111 and 113. Each slot set 109, 111, 113 includes first and second slots such as 77, 79, respectively, as described above. And as also described above, each of the first and second slots of each slot set 109, 111, 113 has a pin-support portion 81 and a clearance region 83 between the slots. Each shelf 10 of plural shelves 10 and the shelf support apparatus 11 are configured as described above.

As mentioned above, the new store fixture 13 is preferably configured to permit storing, out of sight, unused shelves 10. Referring to FIGS. 2, 3, 4 and 6, the fixture 13 includes the storage section 29 between the lateral stanchions 25, 27. The storage section 29 has the pair of spaced wall members 21, 23 extending between the stanchions 25, 27. In the preferred fixture 13, there is at least one support device 115, e.g., a horizontal, shelf-like "rail" or the like, extending between and affixed to the wall members 21, 23. The wall members 21, 23 and the support device 115 form an elongate storage tunnel 117 for receiving a shelf 10 therein for storage. The end closures 31, 33 permit the storage tunnel 117 to be opened for shelf removal or storage and closed to restore the aesthetic quality of the fixture 13 and to prevent possible shelf theft.

Referring also to FIGS. 2, 3, 4, 12 and 17, each end closure 31, 33 includes an arcuate exterior panel 119 formed of a material which is either translucent or transparent so that light can be transmitted therethrough. An interior panel 121 supports a lamp 123, the light from which is visible through the exterior panel 119. Sales-related text, images or both may be applied to such panel 119.

Referring now to FIGS. 3, 4, 6 and 12, the spaced wall members 21, 23 define a gap 39 between them. An aesthetically pleasing closure member 41, e.g., a finished wood strip or the like is atop the gap 39 and, front to rear, extends between the wall members 21, 23. A vertically sliding sign board 43 extends through a slot 125 in the closure member 41. The sign board 43 can be withdrawn and displayed above the closure member 41 or pushed downwardly into the gap 39 for storage.

Other Embodiments and Features

FIGS. 6–10 and 12–16 show the preferred pin configuration and pin locations. But, as noted above, other pin locations are possible. Referring to FIGS. 6, 8, 10 and 18 (which show the apparatus 11*a* which is to the viewer's left when such viewer is viewing the fixture 13 along the viewing axis VA of FIG. 6), the first pin 55 is located so that the top surface 71 of the shelf 10 is tangent therewith and the second pin 53 is located so that the shelf edge 69 is tangent thereto and the pin 53 is closely proximate the shelf bottom surface 73. To state it another way (and when the shelf 10 is horizontal), the pin center axes 127, 129 are coincident with separate horizontal planes 131, 133, respectively, which are vertically spaced apart.

The first and second slots 137, 139, respectively, are relatively located so that when the pins 53, 55 are in the pin support portions 143, 141 of such slots 139, 137, respectively, the shelf 10 is horizontal. From the foregoing, it is apparent that shelves 10 of differing thickness and having pins differently located thereon can nevertheless be accommodated by appropriate slot location.

As used herein, the term "support pin" and like terms means any structural component protruding from a shelf end surface for shelf support. Unless the context requires otherwise, a support pin may have any cross-sectional shape. For ease of manufacture and use, support pins with circular cross-sectional shapes are highly preferred.

Unless the context requires otherwise as, (e.g., in the case of a shelf 10 and support apparatus 11*a*, 11*b* which are part of a retail store fixture for displaying products for sale), the term "shelf" means a generally planar structure supporting or capable of supporting persons or things. As non-limiting examples, a worker's scaffold, a household closet, an entertainment center, a desk top and a store display fixture 13 would all include a shelf.

In all of the inventive embodiments, each embodiment includes at least first, second, third and fourth couplers where two of the couplers are pins and the other two couplers are slot delineators. While the embodiment described above includes pins connected to a shelf or brace member and delineators connected to or formed by support or frame members, it should be appreciated that the invention is broad enough to cover many other embodiments. For example, referring to FIGS. 19A and 20, in a second embodiment a single member 211 extends from and forms slot delineators 200 and 202 on a shelf edge 201 while pins 204 and 206 which cooperate with delineators 200 and 202 extend from support members 208 (only one illustrated). In FIG. 20, pins 204 and 206 define a coupling plane 217 adjacent and parallel to a vertical surface of frame member 208. Referring also to FIGS. 19C–19D, delineator 200 forms a pivot zone 203 and also forms a hanging surface 220. In addition, each of the delineators 200 and 202 forms a support surface 212, 214, respectively, and, referring to FIG. 19B, forms a passageway 225, 227 which defines a path 221, 223 (see FIG. 19E) from a corresponding support surface 212, 214, respectively. The passageways 221, 223 are each wide enough for one of the pins to pass through.

In FIGS. 19A–19E, shelf 210 is shown in a number of positions as shelf 210 is first mounted to frame member 208 in a horizontal position and then as shelf 210 is moved from the horizontal position to a vertical hanging position. Referring to FIGS. 19A and 20, to mount shelf 210 to pins 204 and 206, shelf 210 is positioned such that delineator 200 is above pin 204. Although not illustrated, a similar delineator on the opposite end of shelf 210 is also aligned with a pin. With shelf 210 so positioned, shelf 210 is angled so pin 204 enters passageway 225. Then shelf 210 is pulled forward until delineator 202 drops over pin 206. At this point pins 204 and 206 bear against support surfaces 212, 214 respectively and shelf 210 is supported in the horizontal position (see FIG. 19C).

To move shelf 210 to the vertical storage position, the front end of shelf 210 is lifted so that pin 206 is below delineator 202. Then, shelf 210 is pushed back so that pin 204 is within zone 203 (see FIG. 19D). At this point, shelf 210 can be rotated downward about pin 204. Delineator 202 is dimensioned and juxtaposed with respect to zone 203 such that, during rotation of shelf 210 about pin 204, delineator 202 does not contact pin 206. In other words, as shelf 210 is rotated, pin 206 is outside the path swept by delineator 202 and member 211 so that shelf 210 is rotated into the vertical position unobstructed. Once member 211 has passed pin 206, pin 204 is received on arcuate hanging surface 220 for vertical storage (see FIG. 19E).

Referring again to FIG. 19A, pins 204 and 206 form a "clearance region" generally referred to by numeral 222. Referring also to FIG. 13, the clearance region 83 in the embodiment illustrated in FIG. 13 is clearly delineated as the area between surfaces 85 and 87. In the embodiment illustrated in FIG. 19A, referring also to FIG. 20, the clearance region 222 is the entire region which resides in coupling plane 217 along the surface of wall 208. Thus, herein, the term "clearance region" is generally taken to mean any region which is coplanar with the couplers which are connected to a frame or support member 208 and which is outside an area defined by any one of the couplers on the frame or support member 208.

Referring to FIG. 19E, when shelf 210 is mounted to member 208 in the vertical position, each of paths 221 and 223 opens into clearance region 222. As indicated above, each of paths 221, 223 is wide enough that a pin (e.g. 204, 206) can pass therethrough. By moving shelf 210 perpendicular to the longitudinal axis (ee 231 in FIG. 20) of shelf 210, shelf 210 can be manipulated such that each of the first and second pins pass through their respective paths 221, 223 and the couplers on the shelf are both within clearance region 222. When so positioned shelf 210 is de-coupled from support member 208.

Referring still to FIG. 19A, as indicated above, it should be appreciated that a second frame member similar to member 208 is preferably positioned opposite member 208 and is coupleable to an opposite end of shelf member 210. To this end, the embodiment preferably includes fifth, sixth, seventh and eighth couplers at the opposite shelf end wherein two of the fifth through eighth couplers are similar to pins 204 and 206 and the other two of the fifth through eighth couplers are similar to delineators 200 and 202. In the present embodiment the two couplers connected to shelf 210 are delineators which form additional passageways which define paths while the couplers connected to the other support member are pins which define a second clearance region (not illustrated) which is essentially identical to region 222.

Referring now to FIG. 21, in a third embodiment, like the second embodiment, a single member 241 forms slot delineators 230, 232 on a shelf edge while pins 234, 236 which cooperate with delineators 230, 232 are connected to support members 238 (only one support member illustrated). Member 238 and pins 234, 236 are identical to member 208 and pins 204, 206 (see FIG. 19A) and therefore are not described again in detail. Similarly, delineator 232 is similar to delineator 202 (see FIG. 19A) and therefore is not again described. However, delineator 230 is unique in that delineator 230 opens upwardly and to a rear of a shelf 240. In this example a pivot zone is identified by number 242 and a support surface is identified by member 245. In light of the explanation above with respect to FIGS. 19A–20, operation of the embodiment of FIG. 21 should be clear to one skilled in the art and therefore a detailed explanation is forgone here. However, one distinction between operation of the second and third embodiments is of import. To this end, although not illustrated, it should be noted that while delineators 202 and 232 have a similar design and while delineator 202 may or may not define a hanging surface, delineator 232 does form a hanging surface 247 which would cooperate with another pin (not illustrated) below pin 234 to support shelf 240 in the vertical position.

While each of the first and second delineators in the second and third embodiments are illustrated as being formed by a single extension member, each may be separately formed. For example, referring to FIGS. 22 and 23, and also to FIG. 21, each of the limiting surfaces in FIG. 21 are also provided in the embodiment of FIGS. 21 and 23 by separate first and second delineator extensions 250, 252. Extension 250 forms pin support surface 254 and a hanging surface 256 while extension 252 forms pin support surface 258 and a pivot zone 260. In light of the description above, one of ordinary skill in the art should understand operation of the embodiment of FIGS. 22 and 23 and therefore operation is not explained here in detail.

Referring to FIG. 24, yet another preferred embodiment is illustrated which includes pins 270 and 272 connected to a shelf 288 (shown in phantom) and which cooperate with separate delineators or delineator members 274, 276 extending from a support or frame member 278. Delineator 274 forms a pin support surface 280, a pivot zone 282 (in phantom) and a hanging surface 284 while delineator 276 forms an upwardly facing arcuate pin support surface 286. Shelf 288 is illustrated in a horizontal position with pin 270 bearing against surface 280 and pin 272 bearing down on surface 286.

To move shelf 288 from the horizontal to the vertical positions shelf 288 is rotated slightly upwardly so that pin 272 is above surface 286, shelf 288 is moved forward so pin 270 moves into pivot zone 282 and shelf 288 is rotated downward about pin 270 into the vertical position. With pin 270 in zone 282, when shelf 288 is rotated, pin 272 is unobstructed by delineator 276. Once shelf 288 is vertical, shelf 288 is lowered until pin 270 bears upon hanging surface 284 and shelf 288 is supported thereby.

Referring still to FIG. 24, to dismount shelf 288 from support member 278, a user grasps and raises shelf 288 and then moves shelf 288 toward delineator 276 such that pin 270 passes through passageway 290 and into clearance region 292 (i.e. the region within the plane of delineators 274, 276 along the surface of member 278 which is not within one of the delineator prescribed passageways).

Referring now to FIG. 25, another and preferred embodiment 300 of the invention is illustrated. Embodiment 300 is similar to the first embodiment (see FIGS. 7 and 13 through 16) in that pins 302 and 304 are mounted to a shelf member 306 show in phantom) while support strips 308, 310 are mounted to a frame member 312. In FIG. 25, frame member 312 has an aft end 313, a fore end 315, a top 317 and a bottom 319. Shelf member 306 has first and second oppositely facing surfaces 350, 352, respectively.

Each of strips 308 and 310 forms a plurality of vertically spaced slot delineators. Exemplary facing delineators include delineator 314 and delineator 316. Other facing delineators include delineators 372 and 376. Facing delineators form coupler or delineator pairs and the delineators in each pair are mirror images of each other. For example, delineators 314 and 316 form a coupler pair and, in this example, are mirror images of each other. To this end, delineator 314 forms a passageway (generally 318) having a first support surface 320, a pivot zone 322 (in phantom) and a hanging surface 325. Similarly, delineator 316 forms a passageway (generally 324) having a second support surface 326 and a pivot zone 328 (in phantom). In addition, second support surface 326 doubles as a hanging surface. A clearance region 340 is formed between strips 308 and 310 and each of delineators 314, 316 opens into region 340.

Referring still to FIG. 25, as illustrated, pins 302 and 304 are spaced along the shelf edge such that shelf 306 can be positioned in a first horizontal position wherein pin 304 bears down on surface 326 and pin 302 bears up against surface 320. When in this first position, surface 350 faces upward. To decouple shelf 306 from member 312, shelf 306 is rotated about pin 302 so pin 304 is above surface 326. Shelf 306 is manipulated such that pin 302 and pin 304 follow paths 356, 358, respectively, and simultaneously. With pin 302 in pivot zone 322, shelf 306 is rotated down until pin 304 is within clearance region 340. Next, shelf 306 is manipulated so that pin 302 passes back along path 356 and exits delineator 314 into region 340. With pins 302 and 304 in region 340, affirmative manipulative steps consistent with the frame member design are then taken to remove the shelf.

Referring to FIG. 26, embodiment 300 is illustrated in a second horizontal configuration where, unlike the position in FIG. 25, shelf surface 352 faces upward. To this end, in addition to the surfaces and zones described above, delineator 316 further defines a fourth support surface 360 and another pivot zone 362. In addition, surface 325 doubles as a third support surface. In the second horizontal position pin 304 bears down on surface 325 while pin 302 bears up on surface 360. Shelf 306 can be decoupled from its second horizontal position in a manner similar to that described above and therefore, the decoupling method is not explained again in detail.

It should be appreciated that in addition to having different surfaces (e.g. 350, 352 in FIGS. 25 and 26) facing upward, the first and second horizontal positions also can be used to change the direction in which shelf 306 extends (i.e. fore or aft).

The advantages associated with being able to easily flip shelf 306 over are numerous and, among others, include being able to place different advertisements on opposite shelf sides, providing different shelf looks (e.g. light and dark wood) on opposite shelf sides, placing a mirror on one shelf side and so on. It should also be noted that if it is desirable to have shelf 306 extend to fore side 315 of member 312 with surface 352 facing upward, shelf 306 can be removed from member 312, flipped over and remounted to member 312 to facilitate the desired effect. A similar manipulation can be performed to configure shelf 306 to extend to aft side 313 with surface 350 facing upward.

Referring now to FIGS. 27–30, four other configurations which are achievable using embodiment 300 are illustrated. In FIG. 27 shelf 306 is illustrated in a first or aft downward vertical position wherein surface 350 faces fore side 315 and pins 302 and 304 bear against surfaces 325 and 370, surface 370 being formed by delineator 372 below delineator 314. FIG. 28 shows shelf 306 in a second or fore downward vertical position wherein surface 350 also faces fore side 315 but wherein pins 302 and 304 bear against surfaces 326 and 374, surface 374 being formed by delineator 376 below delineator 316. Each of the first and second vertical positions is similar and yet provides a slightly different visual appearance.

Referring to FIG. 29, shelf 306 is illustrated in a first upright vertical position wherein pins 304 and 302 are received by and bear against surfaces 325 and 370, respectively, and surface 352 faces fore side 315. In FIG. 30, shelf 306 is illustrated in a second upright vertical position wherein pins 304 and 302 are received by, and bear against, surfaces 326 and 374, respectively, and surface 352 faces fore side 315. With respect to which surface 350 or 352 faces the fore side in the upright and downward fore and aft vertical positions, as in the case of which surface 350 or 352 faces upward when shelf 306 is in the horizontal positions, it should be appreciated that shelf 306 can be removed, flipped over and remounted to change the fore facing surface. For instance, in FIG. 27, shelf 306 can be removed, flipped and replaced so that surface 352 faces fore side 315 and surface 350 faces aft side 313. Once again, the ability to modify the fore facing surfaces is valuable for advertising and for changing the look of a shelving unit.

Referring now to FIG. 35, one other embodiment 400 of the invention is illustrated. Referring also to FIG. 16, embodiment 400 is identical to the FIG. 16 embodiment with one exception. The unique feature of embodiment 400 is that slots 402 and 403 on an aft side 405 of member **11*b* are much deeper than slots 79 and 95. Specifically, slots 402 and 403 are formed deep enough that when a first shelf 404 (shown in phantom) is in a vertically supported position with pins 405 and 408 bearing on surfaces 410 and 412, in addition to being moved vertically passed the first shelf 404, a second shelf 414 (shown in phantom) can be horizontally supported adjacent (i.e. to the fore side of first shelf 404) the vertical first shelf 404. In addition, slots 402 and 403 are deep enough that when aft pin 416 is in a pivot zone 424 so fore pin 418 can be rotated into a clearance region 426 without obstruction, a rear edge 428 of shelf 414 will not contact shelf 404**.

With embodiment 400 it should be appreciated that one or more shelves can be horizontally positioned adjacent a vertically hanging shelf thereby increasing configuration capabilities of the inventive system.

In addition to providing frame members which facilitate shelf removal by affirmative specific manipulation wherein a shelf is removed by movement fore or aft, another embodiment facilitates removal laterally. To this end, referring to FIG. 36, another embodiment 500 is illustrated. Embodiment 500 is similar to the embodiments described above and therefore most features are not again described here in detail. The primary distinction in embodiment 500 is that a frame member 502 forms a lateral opening 506 within a clearance region 504 which is dimensioned so that a shelf 510 may pass laterally for dismounting and storage. Preferably, only one opening 506 is formed so that member 502 and an associated frame member (not illustrated) generally cooperate to help control a shelf member during vertical movement between facing clearance regions. In this regard it should also be recognized that by providing the tops and/or bottoms of frame members open a shelf could be removed either through the top or the bottom.

Referring now to FIGS. 37 through 40, yet another embodiment 800 of the invention is illustrated. While the previously described embodiments are capable of supporting a shelf in any of several different essentially vertical and horizontal positions, it has been recognized that, in addition to the vertical and horizontal positions, it may be advantageous to have one or more shelf members supported in an angled position. To this end, in addition to being able to support a shelf member in several vertical and horizontal positions, the embodiment of FIGS. 37 through 40 can also support shelf members in several different angled positions.

As in the embodiments above, embodiment 800 includes a shelf member 810 (shown in phantom) having first and second couplers 812, 814 extending laterally from a lateral edge. Similar first and second couplers extend from the oppositely facing lateral edge (not illustrated) of member 810. In the illustrated embodiment first and second couplers 812 and 814 are pins. Forward and reward support strips 802, 804, respectively, define a clearance region 806 therebetween on a first lateral side of shelf member 810. Although not illustrated, similarly configured support members are also provided adjacent the opposite lateral edge of shelf member 810. Each strip 802, 804 forms a plurality of third and fourth couplers, each third coupler formed by strip 802 and identified by numeral 816 followed by a lower case letter (e.g., a, b, c, etc.) to distinguish one third coupler from another. Similarly, couplers formed by strip 804 are identified by numeral 818 followed by a lower case letter. Each third and each fourth coupler is a slot or a slot delineator in this preferred embodiment.

While slots in strips 802 and 804 are similarly shaped, there are two primary distinctions between the slots which are worth noting. First embodiment 800 includes twice as many slots in strip 802 as in strip 804. Second, slots in strip 804 are much deeper than slots in strip 802. For example, compare slot 816*a* and slot 818*a* wherein slot 818*a* is relatively deep. These two distinguishing features, additional slots and deeper slots in strip 804, facilitate angled shelf member support.

Referring specifically to FIG. 37, shelf member 810 is shown in a horizontal supported position with pin 812 received within a recess 820*a* in slot 816*a* and pin 814 bearing against an upper surface 822 of slot 818*a*. It should be appreciated that shelf member 810 can be manipulated out of the horizontal position illustrated by lifting a distal shelf end (not illustrated) so pin 812 is above recess 820, forcing shelf 810 backward so that pin 814 is within a pivot region 824 (shown in phantom) in slot 818*a* and so that pin 812 can swing into clearance region 806 essentially unobstructed.

Referring also to FIG. 38, if manipulated properly, pin 812 can be moved into a support recess 820*b* of a second third coupler or slot 816*b* which is vertically spaced below slot 816*a*. Because slot 818*a* is relatively deep, pin 814 remains therein and bears against upper surface 822 when downward pressure is applied to the distal end of shelf member 810. Comparing shelf member positions in FIGS. 37 and 38, member 810 in FIG. 38 is angled downwardly and yet is fully supported.

Referring now to FIGS. 38 and 39, just as the angled position in FIG. 38 is achievable via shelf manipulation, so to the angled position of FIG. 39 is achievable wherein pin 812 is received within a recess 820*d* of yet another third coupler or slot 816*d* and pin 814 bears against upper surface 822 of slot 818*a*. In the position of FIG. 39, pin 814 bears against surface 822 at a point closer to clearance region 806 than in the position of FIG. 38. Nevertheless, the position of FIG. 39 is still fully supported.

Referring still to FIG. 39, although not illustrated, it is contemplated that shelf member 810 can be manipulated such that pin 812 is received and supported within slot 816*c* and member 810 is supported in yet a third downwardly angled position which is steeper than the position of FIG. 38 but not as steep as the position of FIG. 39.

Referring to FIG. 40, shelf member 810 may also be manipulated such that pin 812 is received within a slot above the slot which receives pin 814 so that shelf member 810 is supported in an upwardly angles position. As illustrated, pin 812 is received within recess 820*a* and so that pin 814 bears upwardly against an upper surface 826 of slot 818*b*. Just as several downwardly angled shelf positions are contemplated, several upwardly angled positions are also contemplated. In addition, although not illustrated, it should be appreciated that the spacing of slots in strips 802 and slots in strips 804 should be such that pins 812 and 814 can be received within vertically separated slots for vertical shelf storage.

Referring now to FIG. 41, a support assembly 850 is illustrated which can be used with any of the embodiments described above to facilitate angled shelf support. Referring also to FIG. 43, bar assembly 850 is to be used with a shelf member 860 (shown in phantom) and strips 862 and 864 similar to the embodiments described above. To this end, shelf member 860 includes at least a first coupler 878 which extends from a lateral shelf edge and also forms a planar undersurface 880. In the illustrated embodiment another coupler 876 also extends laterally in the same direction as coupler 878 and each of couplers 876 and 878 are pins. In addition, strips 862 and 864 form forward and reward couplers, forward couplers being slots identified by numeral 866 followed by a lower case letter to distinguish one from another and rearward couplers also being slots identified by numeral 868 and followed by a lower case letter to distinguish one slot from others.

Referring again to FIG. 41, assembly 850 includes a bar 851 having second couplers 853 and 855 in the form of pins extending from opposite bar end surfaces. Referring also to FIG. 42, bar 851 is preferably rectilinear in cross-section having oppositely facing first and second sides 852 and 854, respectively, and oppositely facing third and fourth sides 856, 858, respectively. Pin 853 is positioned a unique distance away from each of surfaces 852, 854, 856 and 858. Thus, pin 853 is a first distance D8 from surface 852, a second distance D9 from surface 854, a third distance D10 from surface 856 and a fourth distance D11 from surface 858 and each of distances D8 through D11 are different.

In operation, referring still to FIG. 43, assembly 850 is mounted at either end to forward lateral support strips (e.g.

862) by placing pins (e.g., 853) within slot recesses (e.g., 870). When so mounted, bar 851 can rotate about pins 853 and 855 so that any of surfaces 852, 854, 856 or 858 faces generally upwardly. In FIG. 43, surface 858 faces upwardly.

To support shelf 860 at an angle with assembly 850 mounted between facing strips (e.g. 862), shelf 860 is manipulated such that pin 878 is received within slot 868*a* and shelf 860 is above bar 851. Then shelf 860 is lowered until undersurface 880 rests on surface 858. Undersurface 880 abuts flatly against surface 858 and therefore prohibits bar 851 rotation. In this position pin 876 is within a clearance region 882 between strips 862 and 864 and pin 878 bears against an upper surface 884 of slot 868*a*. Pin 876 bears against a surface of clearance region 882 and therefore prohibits movement of shelf member 860. Bar 851 supports shelf 860 at a first angle A1 with respect to a horizontal plane as illustrated.

Referring now to FIG. 44, to modify the angle at which shelf 860 is supported, the distal end of shelf 860 can be lifted and bar 851 can be rotated so that a different bar surface (e.g., 852, 854, 856) faces upwardly. Shelf 860 is lowered so that undersurface 880 rests on the generally upwardly facing surface. For instance, in FIG. 44, surface 854 faces upward. Referring to FIGS. 42, 43 and 44, because distances D4 and D2 are different, the angel A2 formed by shelf 860 is different when surface 880 rests on surface 854 than when surface 880 rests on surface 858. Similarly, two other angles can be configured by rotating bar 851 so that one of the other two surfaces (e.g., 852, 856) faces upwardly. Preferably, distances D8 through D11 are selected such that standard viewing angles (e.g., 15°, 30°, etc.) are achievable.

Other embodiments of the invention are contemplated. For example, referring again to FIGS. 37 through 40, while first and second couplers 812 and 814 are pins while third and fourth couplers 816 and 818 are slots, other embodiments may include first and second couplers which are slots and third and fourth couplers which are pins. Similar comments can be made with respect to the embodiment described by reference to FIGS. 41 through 44.

In addition, while assembly 580 in FIG. 41 preferably includes four surfaces which are uniquely spaced from pins 853 and 855, other designs are contemplated wherein less or more than four surfaces may be included on bar 851. For instance, one embodiment may include a spiral which includes a smooth surface which wraps around coupler pins, any point on the surface being a unique distance from the pins when compared to any other point. This type of bar would enable a shelf to be supported in virtually any angled position.

Referring to FIG. 45, an angle support 900 which can be used to support a shelf in an angled position is illustrated. Support 900 is a rigid block including a top surface 902, a bottom surface 903 opposite top surface 902, a front surface 904, a rear surface opposite front surface 904 and two lateral surfaces 906 and 908. A width dimension W is between surfaces 906 and 908 while a girth dimension G is between front surface 904 and the oppositely facing rear surface. A channel 910 is formed in bottom surface 903 which extends approximately three quarters of the way toward top surface 902 and traverses the distance between front surface 904 and the oppositely facing rear surface (not illustrated). Channel 910 has a width which is wide enough to accommodate one of the pins (e.g. 59 or 61 in FIG. 16) extending laterally from a shelf member.

Referring also to FIG. 46, a frame/support assembly 11*b* and shelf 10 like the assembly and shelf of FIG. 16 is illustrated. Clearance region 83 is defined by a dimension D5 and has a depth D6 (see D6 in FIG. 12). Width W and girth G are slightly less than dimensions D5 and D6, respectively, of clearance region 83 such that support 900 is snugly receivable within region 83 as illustrated in FIG. 46. When in region 83, support 900 can be slid vertically up and down unless impeded by a shelf 10.

To support a shelf 10 in an angled position, two supports 900 are used. A separate support 900 is positioned in each of two facing clearance regions 83 (only one support 900 illustrated in FIG. 46). Then, with blocks 900 above shelf 10, shelf 10 is manipulated such that a rear pin 59 is received in a slot 79 while pin 61 is within clearance region 83. Next, each of supports 900 is slid down such that pins (e.g. 61) in region 83 are received in channels 910. When so positioned, supports 900 cooperate with slots (e.g., 79) to maintain shelf 10 angled as illustrated. To this end, slot 79 restricts downward shelf movement while supports 900 restrict horizontal movement.

The embodiment of FIGS. 45 and 46 is thought to be relatively less expensive to manufacture than the previously described embodiments which support angled shelves and therefore is considered advantageous.

Referring now to FIGS. 47 through 51, yet another embodiment 1000 of the present invention is illustrated. It should be appreciated that, in the interest of simplifying this explanation, only a single frame member 1002 and a single shelf member 1004 are illustrated and that, nevertheless, a working embodiment would include a second frame member (not illustrated) opposite frame member 1002.

Shelf member 1004 includes a top surface 1006, a bottom surface 1008, a rear surface 1010 and a first end surface 1011. In addition, although not illustrated, shelf member 1004 also includes a second end surface which faces in a direction opposite surface 1011 and defines a front edge having a front surface which faces in the direction opposite rear surface 1010. Proximate rear surface 1010, a longitudinal axis 1012 passes through shelf member 1004 that is parallel to rear surface 1010.

Referring still to FIGS. 47 through 51, a first rear extending member 1014 extends from rear surface 1010 in a direction perpendicular to axis 1012 and such that the extending member 1014 is flush with first end surface 1011. A top surface 1016 of rear extending member 1014 forms a first bearing surface.

Referring still to FIGS. 47 through 51, an end extending member or pin 1018 extends laterally from first end surface 1011 parallel to axis 1012. As illustrated, axis 1012 passes through the center of pin 1018. As best seen in FIG. 50, a bottom surface 1020 of pin 1018 forms a second bearing surface. Referring to FIGS. 49 and 50, the first and second bearing surfaces 1016 and 1020 define a first dimension L1 within a first plane 1022.

Upright frame member 1002 includes at least first and second walls 1024 and 1026, respectively. Walls 1024 and 1026 form an angle therebetween and, in the embodiment illustrated, form a right angle so that the walls are perpendicular. In the embodiment illustrated wall 1024 is curved although such curvature is not necessary to practice the present invention. First wall 1024 forms a plurality of equi-spaced opening delineators 1028, 1030 and 1032. All of the delineators have similar configurations and therefore only delineator 1028 will be described here in detail. Referring to FIG. 50, delineator 1028 includes a passageway 1034 which is essentially horizontal and, at an inward end, extends downwardly to form a pin receiving third bearing surface 1036. The passageway 1034 opens at an egress 1038 in a direction opposite second wall 1026.

Second wall 1026 forms a plurality of equi-spaced rear couplers, a single rear coupler associated with each one of the opening delineators formed by first wall 1024. The rear couplers are configured such that they may cooperate with rear extending members 1014 to maintain shelf 1004 in an essentially horizontal position. To this end, in the embodiment illustrated in FIGS. 47 through 51, each rear coupler comprises an additional opening delineator which is simply a hole or opening in the second wall 1026 which is essentially aligned with a corresponding opening delineator formed by the first wall 1024. For example, the opening delineator formed by second wall 1026 that is aligned with delineator 1030 is identified by numeral 1040 and is simply a rectilinear opening formed by wall 1026. A downward facing surface 1042 (see FIG. 50) of delineator 1040 forms a fourth bearing surface. Referring to delineator 1030 and 1040 in FIG. 50, the third and fourth bearing surfaces 1036 and 1042, respectively, define a second dimension L2 in a second plane which is essentially identical to the first dimension L1.

Referring now to FIGS. 47 and 48, to horizontally mount shelf member 1004 to frame member 1002 (and a second frame member not illustrated), shelf member 1004 is held in an essentially horizontal position and the end extending pins (e.g., 1018) are aligned with opening delineators (e.g., 1030) while rear extending member 1014 are aligned with opening delineators formed by the second walls 1026. When so aligned, shelf member 1004 is moved toward the frame member second wall (e.g., 1026) such that rear extending members 1014 pass into delineators 1040 and end extending members 1018 pass through passageways 1034. Next, shelf member 1004 can be released to that pin 1018 comes to reset within delineator 1030. When so positioned, first bearing surface 1016 bears up against fourth bearing surface 1042 while second bearing surface 1020 bears down against third surface 1036 thereby supporting shelf member 1004 in the horizontal position. To remove shelf member 1004, a reverse operation takes place whereby the front end of the shelf is lifted upwardly so that pin 1018 moves into passageway 1034. Thereafter, the shelf can be pulled forward and away from second wall 1026 until both extending members 1014 and 1018 are free of the opening delineators.

Referring to FIG. 51, shelf member 1004 can also be mounted to frame member 1002 in a supported vertical position. To mount shelf member 1004 to frame member 1002 in the vertical position, shelf member 1004 is held in an essentially vertical position and extension member 1018 and a similar second extension member extending from the opposite surface of shelf member 1004 are aligned with first wall opening delineator passageways 1044. Next, the shelf member 1004 is moved towards second wall (e.g., 1026) until such movement is limited by member 1018. At that point shelf member 1004 is released so that extending member 1018 drops down and is supported on surface 1036. To this end, pin 1018 forms a hanging surface 1050 which faces in the direction opposite rear surface 1010. When supported in the vertical position, hanging surface 1050 bears against third bearing surface 1036.

Referring still to FIGS. 47 through 51, to limit swinging about extending members 1018 when shelf member 1004 is mounted in the vertical position, in one embodiment, first wall 1024 forms a distal edge 1052 adjacent egress 1038 and opposite second wall 1026. The distal edge 1052 and third bearing surface 1036 define a third essentially horizontal dimension L3 (see FIGS. 49 and 50). In addition, shelf member 1004 forms a planar limit extension 1060 that extends from end surface 1011 essentially parallel to end extending member 1018. The limit extension 1060 and the hanging surface 1050 define a fourth dimension L4 perpendicular to the first dimension L1 and in the first plane wherein the third and fourth dimensions L3 and L4, respectively, are essentially identical (see L4 in FIG. 50). When limit member 1060 is so configured with respect to extending member 1018, as illustrated in FIG. 51, the surface of limit member 1060 facing edge 1052 when shelf member 1004 is in the vertical position bears against edge 1052 thereby limiting rotation of shelf member 1004 about extending member 1018.

As indicated above, while not illustrated, the embodiment of FIGS. 47 through 51 would include a second essentially upright frame member including third and fourth walls that define delineators or other types of coupler assemblies such that there would be additional components and features essentially identical to the components and features described above. For example, there would be additional first, second, third and fourth bearing surfaces and so on.

Referring now to FIGS. 53 and 54, yet another embodiment similar to the embodiment illustrated in FIGS. 47 through 51 is illustrated. In this embodiment, many of the components are similar to the embodiment of FIGS. 47 through 51 and therefore, only distinctions between the two embodiments will be described. In this embodiment, upright frame member 1080 includes first and second walls 1082 and 1084 that form a right angle. First wall 1082 forms opening delineators (e.g., 1086) similar to the delineators illustrated in FIG. 50. However, the opening formed by second wall 1084 is different in that the opening 1088 extends to a distal edge 1090 of the wall 1084. A downwardly facing surface 1091 of delineator 1088 forms the fourth bearing surface.

Another distinction regarding the configurations of FIGS. 53 and 54 is that a top surface of shelf member 1092 forms the first bearing surface 1094. Thus, referring again to FIG. 51, in this embodiment rear extending members 1014 are not required. When mounted in the horizontal position, the rear portion of shelf member 1092 is received within delineators 1088 so that surface 1094 bears up against surface 1091.

Referring now to FIGS. 55 and 56, yet one more embodiment of the invention which is similar to the embodiment of FIGS. 47 through 51 is illustrated. Because of the similarities of the embodiments only distinctions are described here. In FIG. 55 all that is illustrated is a single upright frame member 1098 and a shelf member 1092. Frame member 1098 includes a first wall 1100 and a second wall 1102. First wall 1100 is similar to the wall described with respect to FIG. 53. However, second wall 1102, instead of forming rear couplers by defining opening delineators, includes a frame extending member 1104 that extends essentially parallel to second wall 1100 and in the same direction. A bottom surface 1106 of member 1104 forms the fourth bearing surface in this embodiment and would cooperate with the first bearing surface of a shelf member to maintain the shelf in the horizontal position.

Referring to each of the three configurations described with respect to FIGS. 47 through 51 and 53 through 56 is should be appreciated that each of these embodiments is advantageous over the previously described embodiments for a number of reasons. First, because the upright frame members are relatively simple, construction of any of these embodiments would be relatively less expensive than construction of the previously described embodiments. Second, removal of a shelf in any of these last described embodiments and insertion and mounting of a shelf is relatively easy as, when the end extending pins are freed from their corresponding opening delineators, the shelf is easily removable without twisting or turning the shelf within frame member sections which can be tedious.

While the principles of the invention have been shown and described in connection with preferred embodiments, it is to be understood clearly that such embodiments are by way of example and are not limiting. For example, referring to FIG. 57, the embodiment illustrated is similar to the embodiment of FIG. 51. The distinctions between the FIGS. 51 and 57 embodiments are that extending member 1014 in FIG. 57 is tapered to facilitate easy reception in openings 1040 and in FIG. 57 another lateral extending pin 1300 is provided on shelf 1004 to take the place of extension 1060 in FIG. 51. To apprise the public of the scope of the present invention the following claims are made.

What is claimed:

1. A support apparatus comprising:

at least one shelf member having a longitudinal axis, an end surface essentially perpendicular to the axis and a rear surface essentially parallel to the axis;

a rear extending member mounted to and extending from the rear surface essentially perpendicular to the axis, a top surface of the rear extending member forming a first bearing surface;

an end extending member mounted to and extending from the end surface essentially parallel to the axis, a bottom surface of the end extending member forming a second bearing surface, a first plane parallel to the end surface; and an essentially upright frame member including a first wall and a second wall that forms an angle with the first wall, the first wall having a distal edge facing in a direction opposite the second wall and forming an opening delineator including a third bearing surface and a passageway that opens to form an egress through the distal edge in a direction opposite the second wall, the passageway wide enough that the end extending member can pass therethrough, the second wall forming a rear coupler, a downwardly facing surface of the rear coupler forming a fourth bearing surface, a second plane essentially parallel to the first wall, the third and fourth bearing surfaces defining an essentially horizontal second dimension in the second plane that is essentially equal to the first dimension;

wherein, the shelf member may be operatively mounted to the frame member in a horizontal position wherein the first bearing surface bears against the fourth bearing surface and the second bearing surface bears against the third bearing surface.

2. The apparatus of claim 1, wherein a rear section of the shelf member forms the rear extending member and a top surface of the shelf member forms the first bearing surfaced.

3. The apparatus of claim 1 wherein the delineator is a first delineator and the rear coupler forms a second opening delineator that receives the rear extending member.

4. The apparatus of claim 1 wherein the rear coupler forms a frame extending member that extends toward the delineator.

5. The apparatus of claim 1 wherein the first and second walls are essentially perpendicular.

6. The apparatus of claim 1 wherein the first wall forms a distal edge adjacent the egress and opposite the second wall, the distal edge and third bearing surface define a third essentially horizontal dimension, the shelf member forms a limit extension that extends from the end surface essentially parallel to the extending member, an end extending member surface facing in the direction opposite the rear surface forms a hanging surface and the limit extension and hanging surface define a fourth dimension perpendicular to the first dimension and in the first plane wherein the third and fourth dimensions are essentially identical.

7. The apparatus of claim 1 wherein the apparatus further includes a second essentially upright frame member including at least a third wall essentially parallel to the first wall, the end extending member is a first end extending member, the delineator is a first delineator, the end surface is a first end surface, the shelf member forms a second end surface that faces in a direction opposite the first end surface, a second end extending member is mounted to and extends from the second end surface essentially parallel to the axis, a bottom surface of the second end extending member forms an additional second bearing surface, the first and additional second bearing surfaces defining the first dimension in a third plane parallel to the second end surface and passing through the additional second bearing surface, the third wall forming a second opening delineator, an upward facing surface of the second delineator forming an additional third bearing surface and the second delineator also forming a passageway that opens to form another egress in a direction opposite the rear coupler, the passageway wide enough that the second end extending member can pass therethrough, the fourth and additional third bearing surfaces also defining the essentially horizontal second dimension in a fourth plane parallel to the third wall.

8. The apparatus of claim 7 wherein the second frame member also includes a fourth wall essentially perpendicular to the third wall, the rear coupler is a first rear coupler and the apparatus also includes a second rear coupler, the rear extending member is a first rear extending member and the apparatus includes a second rear extending member extending from the rear surface adjacent the second end surface, a top surface of the second rear extending member forming an additional second bearing surface, a downwardly facing surface of the second rear coupler forming an additional fourth bearing surface, the additional first and additional second bearing surfaces defining the first dimension within the third plane and the additional third and additional fourth bearing surfaces defining the second dimension within the fourth plane.

9. The apparatus of claim 8 wherein the delineator is a first delineator and the rear coupler forms a second opening delineator that receives the rear extending member.

10. The apparatus of claim 9 wherein the first wall forms a distal edge adjacent the egress and opposite the second wall, the distal edge and third bearing surface define a third essentially horizontal dimension, the shelf member forms a limit extension that extends from the end surface essentially parallel to the extending member, an end extending member surface facing in the direction opposite the rear surface forms a hanging surface and the limit extension and hanging surface define a fourth dimension perpendicular to the first dimension and in the first plane wherein the third and fourth dimensions are essentially identical.

11. A support apparatus comprising:

at least one shelf member having a longitudinal axis, first and second oppositely facing end surfaces essentially perpendicular to the axis and a rear surface essentially parallel to the axis;

first and second rear extending members mounted to and extending from the rear surface essentially perpendicular to the axis and adjacent the first and second end surfaces, respectively, a top surface of the first rear extending member forming a first bearing surface and a top surface of the second rear extending member forming an additional first bearing surface;

first and second end extending members mounted to and extending from the first and second end surfaces essentially parallel to the axis, a bottom surface of the first end extending member forming a second bearing surface and a bottom surface of the additional first end extending member forming an additional second bearing surface, a first plane parallel to the first end surface and passing through the second bearing surface, the first and second bearing surfaces defining a first dimension in the first plane, a third plane parallel to the second end surface and passing through the additional second bearing surface, the additional first and additional second bearing surfaces defining the first dimension in the third plane; and first and second essentially upright frame members, the first frame member including essentially perpendicular first and second walls, the second frame member including essentially perpendicular third and fourth walls, the first wall having a distal edge facing in a direction opposite the second wall and forming a first opening delineator including a third bearing surface and a passageway that opens to form an egress through the distal edge of the first wall in a direction opposite the second wall, the passageway wide enough that the first extending member can pass therethrough, the second wall forming a first rear coupler, a downwardly facing surface of the first rear coupler forming a fourth bearing surface, a second plane essentially parallel to the first wall, the third and fourth bearing surfaces defining an essentially horizontal second dimension in the second plane that is essentially equal to the first dimension, the third wall having a distal edge facing in a direction opposite the fourth wall and forming a second opening delineator including an additional third bearing surface and a passageway that opens to form a second egress through the distal edge of the third wall in a direction opposite the fourth wall, the passageway wide enough that the second extending member can pass therethrough, the fourth wall forming a second rear coupler, a downwardly facing surface of the second rear coupler forming an additional fourth bearing surface, a fourth plane essentially parallel to the third wall, the additional third and additional fourth bearing surfaces defining an essentially horizontal second dimension in the fourth plane that is essentially equal to the first dimension;

wherein, the shelf member may be operatively mounted to the frame member in a horizontal position wherein the first bearing surface bears against the fourth bearing surface, the second bearing surface bears against the third bearing surface, the additional first bearing surface bears against the additional fourth bearing surface and the additional second bearing surface bears against the additional third bearing surface.

12. The apparatus of claim 11 wherein the first and second rear couplers form rear opening delineators for receiving the first and second rear extending members.

13. The apparatus of claim 11 wherein the first wall forms a distal edge adjacent the egress and opposite the second wall, the distal edge and third bearing surface define a third essentially horizontal dimension, the shelf member forms a limit extension that extends from the first end surface essentially parallel to the first end extending member, a first end extending member surface facing in the direction opposite the rear surface forms a hanging surface and the limit extension and hanging surface define a fourth dimension perpendicular to the first dimension and in the first plane wherein the third and fourth dimensions are essentially identical.

14. The apparatus of claim 13 wherein the third wall forms an additional distal edge adjacent the second egress and opposite the fourth wall, the additional distal edge and additional third bearing surface define the third essentially horizontal dimension, the shelf member forms a second limit extension that extends from the second end surface essentially parallel to the second end extending member, a second end extending member surface facing in the direction opposite the rear surface forms a second hanging surface and the second limit extension and second hanging surface define the fourth dimension perpendicular to the first dimension and in the third plane.

* * * * *